US008488824B2

(12) United States Patent
Mouhssine et al.

(10) Patent No.: US 8,488,824 B2
(45) Date of Patent: Jul. 16, 2013

(54) AUDIO ENCODING AND DECODING METHOD AND ASSOCIATED AUDIO ENCODER, AUDIO DECODER AND COMPUTER PROGRAMS

(75) Inventors: Adil Mouhssine, Rennes (FR); Abdellatif Benjelloun Touimi, London (GB)

(73) Assignee: France Telecom, Paris (FR)

( * ) Notice: Subject to any disclaimer, the term of this patent is extended or adjusted under 35 U.S.C. 154(b) by 728 days.

(21) Appl. No.: 12/597,771

(22) PCT Filed: Apr. 16, 2008

(86) PCT No.: PCT/FR2008/050671

§ 371 (c)(1),
(2), (4) Date: Apr. 19, 2010

(87) PCT Pub. No.: WO2008/145893

PCT Pub. Date: Dec. 4, 2008

(65) Prior Publication Data

US 2010/0305952 A1 Dec. 2, 2010

(30) Foreign Application Priority Data

May 10, 2007 (FR) ..... 07 03349

(51) Int. Cl.
*H04R 25/00* (2006.01)
*H04R 15/00* (2006.01)

(52) U.S. Cl.
USPC ..... 381/320; 381/94.2

(58) Field of Classification Search
USPC ..... 704/500, 201; 381/27, 300, 310, 381/17, 1, 320, 94.2; 700/94
See application file for complete search history.

(56) References Cited

U.S. PATENT DOCUMENTS

| | | | | |
|---|---|---|---|---|
| 8,379,868 | B2 * | 2/2013 | Goodwin et al. | 381/17 |
| 2007/0239295 | A1 * | 10/2007 | Thompson et al. | 700/94 |
| 2007/0269063 | A1 * | 11/2007 | Goodwin et al. | 381/310 |
| 2008/0144864 | A1 * | 6/2008 | Huon | 381/305 |

FOREIGN PATENT DOCUMENTS

| | | | |
|---|---|---|---|
| FR | 2820573 | A1 | 8/2002 |
| WO | WO 02/23529 | A1 | 3/2002 |

OTHER PUBLICATIONS

ISO/IEC, "Information technology—MPEG audio technologies—Part1: MPEG Surround," ISO/IEC FDIS 23003-1:2006, Geneva, Switzerland, pp. 1-290 (Jul. 21, 2006).

Mouhssine et al., "Structure de codage audio spatialiséà scalabilité hybride," COREA'07, Montpellier, France, retrieved from internet website http://www.lirmm.fr/CORESA07/pdf/27.pdf, pp. 1-5 (Nov. 8-9, 2007).

* cited by examiner

*Primary Examiner* — Fan Tsang
*Assistant Examiner* — Eugene Zhao
(74) *Attorney, Agent, or Firm* — Drinker Biddle Reath LLP

(57) ABSTRACT

The invention relates to a method for sequencing spectral components of elements to be encoded ($A_1, \ldots, A_Q$) originating from an audio scene comprising N signals ($Si_{i=1\ to\ N}$), in which N>1, an element to be encoded comprising spectral components associated with respective spectral bands, characterised in that it comprises the following steps: calculation of the respective influence of at least some spectral components which can be calculated as a function of the spectral parameters originating from at least some of the N signals on the mask-to-noise ratios determined over the spectral bands as a function of the encoding of said spectral components; and allocation of an order of priority to at least one spectral component as a function of the influence calculated for said spectral component compared to the other influences calculated.

13 Claims, 7 Drawing Sheets

AUDIO ENCODING AND DECODING METHOD AND ASSOCIATED AUDIO ENCODER, AUDIO DECODER AND COMPUTER PROGRAMS

CROSS-REFERENCE TO RELATED APPLICATIONS

This application is the U.S. national phase of the International Patent Application No. PCT/FR2008/050671 filed Apr. 16, 2008, which claims the benefit of French Application No. 07 03349 filed May 10, 2007, the entire content of which is incorporated herein by reference.

BACKGROUND

The present invention relates to audio signal encoding devices, intended in particular to find a place in digitized and compressed audio signals storage or transmission applications.

The invention relates more precisely to audio hierarchical encoding systems, having the capacity to provide varied rates, by distributing the information relating to an audio signal to be encoded in hierarchically-arranged subsets, such that this information can be used in order of importance with respect to the audio quality. The criterion taken into account for determining the order is a criterion of optimization (or rather of least degradation) of the quality of the encoded audio signal. Hierarchical encoding is particularly suited to transmission over heterogeneous networks or those having available rates varying over time, or also transmission to terminals having different or variable characteristics.

The invention relates more particularly to the hierarchical encoding of 3D sound scenes. A 3D sound scene comprises a plurality of audio channels corresponding to monophonic audio signals and is also known as spatialized sound.

An encoded sound scene is intended to be reproduced on a sound rendering system, which can comprise a simple headset, two speakers of a computer or also a Home Cinema 5.1 type system with five speakers (one speaker at the level of the screen and in front of the theoretical listener: one speaker to the left and one speaker to the right; behind the theoretical listener: one speaker to the left and one speaker to the right), etc.

For example, consider an original sound scene comprising three distinct sound sources, located at different locations in space. The signals describing this sound scene are encoded. The data resulting from this encoding are transmitted to the decoder, and are then decoded. The decoded data are utilized in order to generate five signals intended for the five speakers of the sound rendering system. Each of the five speakers broadcasts one of the signals, the set of signals broadcast by the speakers synthesizing the 3D sound scene and therefore locating three virtual sound sources in space.

Different techniques exist for encoding sound scenes.

For example, one technique used comprises the determination of elements of description of the sound scene, then operations of compression of each of the monophonic signals. The data resulting from these compressions and the elements of description are then supplied to the decoder.

The rate adaptability (also called scalability) according to this first technique can therefore be achieved by adapting the rate during the compression operations, but it is achieved according to criteria of optimization of the quality of each signal considered individually.

Another encoding technique, which is used in the "MPEG Audio Surround" encoder (cf. "Text of ISO/IEC FDIS 23003-1, MPEG Surround", ISO/IEC JTC1/SC29/WG11 N8324, July 2006, Klagenfurt, Austria), comprises the extraction and the encoding of spatial parameters from all of the monophonic audio signals on the different channels. These signals are then mixed in order to obtain a monophonic or stereophonic signal which is then compressed by a standard mono or stereo encoder (for example of MPEG-4 AAC, HE-AAC, etc. type). At the level of the decoder, the synthesis of the 3D sound scene is carried out based on the spatial parameters and the decoded mono or stereo signal.

The rate adaptability with this other technique can thus be achieved using a hierarchical mono or stereo encoder, but it is achieved according to a criterion of optimization of the quality of the monophonic or stereophonic signal.

Moreover, the PSMAC (Progressive Syntax-rich Multichannel Audio Codec) method makes it possible to encode the signals of different channels by using the KLT (Karhunen Loeve Transform), which is useful mainly for the decorrelation of the signals and which corresponds to a principal components decomposition in a space representing the statistics of the signals. It makes it possible to distinguish the highest-energy components from the lowest-energy components.

The rate adaptability is based on a cancellation of the lowest-energy components. However, these components can sometimes have great significance with regard to overall audio quality.

Thus, although the known techniques produce good results with respect to rate adaptability, none proposes a completely satisfactory rate adaptability method based on a criterion of optimization of the overall audio quality, aimed at defining compressed data optimizing the perceived overall audio quality, during the restitution of the decoded 3D sound scene.

Moreover, none of the known 3D sound scene encoding techniques allows rate adaptability based on a criterion of optimization of the spatial resolution, during the restitution of the 3D sound scene. This adaptability makes it possible to guarantee that each rate reduction will degrade as little as possible the precision of the locating of the sound sources in space, as well as the dimension of the restitution zone, which must be as wide as possible around the listener's head.

Moreover, none of the known 3D sound scene encoding techniques allows rate adaptability which would make it possible to directly guarantee optimum quality whatever the sound rendering system used for the restitution of the 3D sound scene. The current encoding algorithms are defined in order to optimize the quality in relation to a particular configuration of the sound rendering system. In fact, for example in the case of the "MPEG Audio Surround" encoder described above utilized with hierarchical encoding, direct listening with a headset or two speakers, or also monophonic listening is possible. If it is desired to utilize the compressed bitstream with a sound rendering system of type 5.1 or 7.1, additional processing is required at the level of the decoder, for example using OTT ("One-To-Two") boxes for generating the five signals from the two decoded signals. These boxes make it possible to obtain the desired number of signals in the case of a sound rendering system of type 5.1 or 7.1, but do not make it possible to reproduce the real spatial aspect. Moreover, these boxes do not guarantee the adaptability to sound rendering systems other than those of types 5.1 and 7.1.

SUMMARY

The purpose of the present invention is to improve the situation.

To this end the present invention aims to propose, according to a first aspect, a method for sequencing spectral components of elements to be encoded originating from a sound scene comprising N signals with N>1, one element to be encoded comprising spectral components associated with respective spectral bands.

The method comprises the following steps:

calculation of the respective influence of at least some spectral components which can be calculated as a function of spectral parameters originating from at least some of the N signals, on mask-to-noise ratios determined over the spectral bands as a function of an encoding of said spectral components;

allocation of an order of priority to at least one spectral component as a function of the influence calculated for said spectral component compared to the other influences calculated.

A method according to the invention thus allows the arrangement in order of importance with respect to the overall audio quality of the components of element to be encoded.

A binary sequence is constituted after comparison with each other of the different spectral components of the different elements to be encoded of the overall scene, compared with each other with regard to their contribution to the perceived overall audio quality. The interaction between signals is thus taken into account in order to compress them jointly.

The bitstream can thus be sequenced such that each rate reduction degrades the perceived overall audio quality of the 3D sound scene as little as possible, since the least important elements with respect to their contribution to the level of the overall audio quality are detected, in order to be able not to be inserted (when the rate allocated for the transmission is insufficient to transmit all the components of the elements to be encoded) or be placed at the end of the binary sequence (making it possible to minimize the defects generated by a subsequent truncation).

In an embodiment, the calculation of the influence of a spectral component is carried out in the steps:

a—encoding of a first set of spectral components of elements to be encoded according to a first rate;

b—determination of a first mask-to-noise ratio per spectral band;

c—determination of a second rate lower than said first one;

d—deletion of said usual spectral component of the elements to be encoded and encoding of the remaining spectral components of the elements to be encoded according to the second rate;

e—determination of a second mask-to-noise ratio per spectral band;

f—calculation of a variation in mask-to-noise ratio as a function of the differences determined between the first and second mask-to-noise ratios for the first and the second rate per spectral band;

g—iteration of steps d to f for each of the spectral components of the set of spectral components of elements to be encoded for sequencing and determination of a variation in minimum mask-to-noise ratio; the order of priority allocated to the spectral component corresponding to the minimum variation being a minimum order of priority.

Such a process thus makes it possible to determine at least one component of an element to be encoded which is the least important with respect to the contribution to the overall audio quality, compared to the set of the other components of elements to be encoded for sequencing.

In an embodiment, steps a to g are reiterated with a set of spectral components of elements to be encoded for sequencing restricted by deletion of the spectral components for which an order of priority has been allocated.

In another embodiment, steps a to g are reiterated with a set of spectral components of elements to be encoded for sequencing in which the spectral components for which an order of priority has been allocated are assigned a more reduced quantification rate during the use of an imbricated quantifier.

In an embodiment, the elements to be encoded comprise the spectral parameters calculated for the N channels. These are then, for example, the spectral components of the signals which are encoded directly.

In another embodiment, the elements to be encoded comprise elements obtained by spatial transformation, for example of ambisonic type, of the spectral parameters calculated for the N signals. This arrangement makes it possible on the one hand to reduce the number of data to be transmitted since, in general, the N signals can be described very satisfactorily by a reduced number of ambisonic components (for example, a number equal to 3 or 5), less than N. This arrangement also allows adaptability to any type of sound rendering system, since it is sufficient, at the level of the decoder, to apply an inverse ambisonic transform of size $Q'\times(2p+1)$, (where Q' is equal to the number of speakers of the sound rendering system used at the decoder output and $2p'+1$ is equal to the number of ambisonic components received), for determining the signals to be supplied to the sound rendering system, while preserving the overall audio quality.

In an embodiment, instead of the spatial transform, other linear transforms such as KLT etc. are used.

In an embodiment, the mask-to-noise ratios are determined as a function of the errors due to the encoding and relative to elements to be encoded and also as a function of a spatial transformation matrix and of a matrix determined as a function of the transpose of said spatial transformation matrix.

In an embodiment, elements to be encoded are ambisonic components, some of the spectral components then being spectral parameters of ambisonic components. The method comprises the following steps:

a. calculation of the influence of at least some of said spectral components, on an angle vector defined as a function of energy and velocity vectors associated with Gerzon criteria and calculated as a function of an inverse ambisonic transformation on said quantified ambisonic components;

b. allocation of an order of priority to at least one spectral component as a function of the influence calculated for said spectral component compared to the other calculated influences.

A method according to the invention thus makes it possible to sequence at least some of the spectral parameters of ambisonic components of the set to be sequenced, as a function of their relative importance with respect to contribution to spatial precision.

The spatial resolution or spatial precision measures the fineness of the locating of the sound sources in space. An increased spatial resolution allows a finer locating of the sound objects in the room and makes it possible to have a wider restitution zone around the listener's head.

The interactions between signals and their consequence with respect to spatial precision are taken into account to compress them in a joint way.

The bitstream can thus be sequenced such that each rate reduction degrades the perceived spatial precision of the 3D sound scene as little as possible, since the least important elements with respect to their contribution are detected, in order to be placed at the end of the binary sequence (making it possible to minimize the defects generated by a subsequent truncation).

In an embodiment of such a method, the angles $\xi_V$ and $\xi_E$ associated with the velocity $\vec{V}$ and energy $\vec{E}$ vectors of the Gerzon criteria are utilized, as indicated below, in order to identify elements to be encoded which are least relevant as regards contribution, with respect to spatial precision, to the 3D sound scene. Thus contrary to customary practice, the velocity $\vec{V}$ and energy $\vec{E}$ vectors are not used to optimize a considered sound rendering system.

In an embodiment, the calculation of the influence of a spectral parameter is carried out in the following steps:

a—encoding of a first set of spectral parameters of ambisonic components to be encoded according to a first rate;

b—determination of a first angle vector per spectral band;

c—determination of a second rate lower than said first;

d—deletion of said usual spectral parameter of the components to be encoded and encoding of the remaining spectral parameters of the components to be encoded according to the second rate;

e—determination of a second angle vector per spectral band;

f—calculation of a variation in angle vector as a function of the differences determined between the first and second angle vectors for the first and the second rate per spectral band;

g—iteration of steps d to f for each of the spectral parameters of the set of spectral parameters of components to be encoded for sequencing and determination of a minimum variation in angle vector; the order of priority allocated to the spectral parameter corresponding to the minimum variation being a minimum order of priority.

This arrangement makes it possible, in a limited number of calculations, to determine the spectral parameter of the component to be determined, the contribution of which to the spatial precision is minimum.

In an embodiment, steps a to g are reiterated with a set of spectral parameters of components to be encoded for sequencing which is restricted by deletion of the spectral parameters for which an order of priority has been allocated.

In another embodiment, steps a to g are reiterated with a set of spectral parameters of components to be encoded for sequencing in which the spectral parameters for which an order of priority has been allocated are assigned a more reduced quantification rate during the use of an imbricated quantifier.

Such iterative methods make it possible to successively identify, among the spectral parameters of the ambisonic components to which orders of priority have not yet been assigned, those which contribute least with respect to spatial precision.

In an embodiment, a first coordinate of the energy vector is a function of the formula $$\frac{\sum_{1\le i\le Q} Ti^2\cos\xi_i}{\sum_{1\le i\le Q} Ti^2},$$

a second coordinate of the energy vector is a function of the formula $$\frac{\sum_{1\le i\le Q} Ti^2\sin\xi_i}{\sum_{1\le i\le Q} Ti^2},$$

a first coordinate of the velocity vector is a function of the formula $$\frac{\sum_{1\le i\le Q} Ti\cos\xi_i}{\sum_{1\le i\le Q} Ti}$$

and a second coordinate of the velocity vector is a function of the formula $$\frac{\sum_{1\le i\le Q} Ti\sin\xi_i}{\sum_{1\le i\le Q} Ti},$$

in which the $T_i$, i=1 to Q, represent the signals determined as a function of the inverse ambisonic transformation on said quantified spectral parameters according to the rate considered and the $\xi_i$, i=1 to Q, are determined angles.

In an embodiment, a first coordinate of an angle vector indicates an angle which is a function of the sign of the second coordinate of the velocity vector and of the arc-cosine of the first coordinate of the velocity vector and according to which a second coordinate of an angle vector indicates an angle which is a function of the sign of the second coordinate of the energy vector and of the arc-cosine of the first coordinate of the energy vector.

According to a second aspect, the invention proposes a sequencing module comprising means for implementing a method according to the first aspect of the invention.

According to a third aspect, the invention proposes an audio encoder suited to encoding a 3D audio scene comprising N respective signals in an output bitstream, with N>1, comprising:

a transformation module suited to determining, as a function of the N signals, spectral components associated with respective spectral bands;

a sequencing module according to the second aspect of the invention, suited to sequencing at least some of the spectral components associated with respective spectral bands;

a module for constitution of a binary sequence suited to constituting a binary sequence comprising data indicating spectral components associated with respective spectral bands as a function of the sequencing carried out by the sequencing module.

According to a fourth aspect, the invention proposes a computer program for installation in a sequencing module, said program comprising instructions for implementing the steps of a method according to the first aspect of the invention during an execution of the program by processing means of said module.

According to a fifth aspect, the invention proposes a method for decoding a bitstream, encoded according to a method according to the first aspect of the invention, with a view to determining a number Q' of audio signals for the restitution of a 3D audio scene using Q' speakers, according to which:

a binary sequence is received;

the encoding data are extracted and, as a function of said extracted data, a set of parameters is determined which are associated with respective spectral bands for each of the Q' channels;

at least one signal frame is determined as a function of each set of parameters.

According to a sixth aspect, the invention proposes an audio decoder suited to decoding a bitstream encoded according to a method according to the first aspect of the invention, with a view to determining a number Q' of audio signals for the restitution of a 3D audio scene using Q' speakers, comprising means for implementing the steps of a method according to the fourth aspect of the invention.

According to a seventh aspect, the invention proposes a computer program for installation in a decoder suited to decoding a bitstream encoded according to a method according to the first aspect of the invention, with a view to determining a number Q' of audio signals for the restitution of a 3D audio scene using Q' speakers, said program comprising instructions for implementing the steps of a method according to the fourth aspect of the invention during an execution of the program by processing means of said decoder.

According to an eighth aspect, the invention proposes a binary sequence comprising spectral components associated with respective spectral bands of elements to be encoded originating from an audio scene comprising N signals with N>1, characterized in that at least some of the spectral components are sequenced according to a sequencing method according to the first aspect of the invention.

BRIEF DESCRIPTION OF THE DRAWINGS

Other characteristics and advantages of the invention will become apparent on reading the following description. This is purely illustrative and must be read in relation to the attached drawings, in which.

DESCRIPTION OF THE PREFERRED EMBODIMENTS

Figure 1:
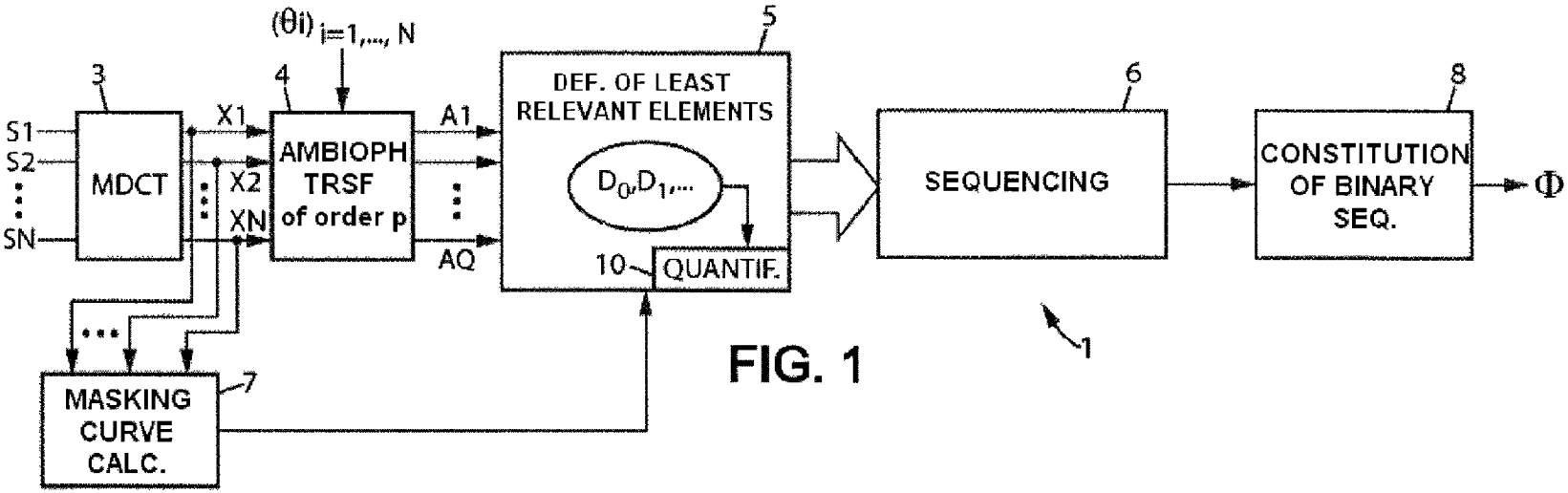
FIG. 1 represents an encoder in an embodiment of the invention.

FIG. 1 represents an audio encoder 1 in an embodiment of the invention.

The encoder 1 comprises a time/frequency transformation module 3, a masking curve calculation module 7, a spatial transformation module 4, a module 5 for definition of the least relevant elements to be encoded combined with a quantification module 10, a module 6 for sequencing the elements, a module 8 for constitution of a binary sequence, with a view to the transmission of a bitstream ϕ.

A 3D sound scene comprises N channels, over each of which a respective signal S1, . . . , SN is delivered.

Figure 2:
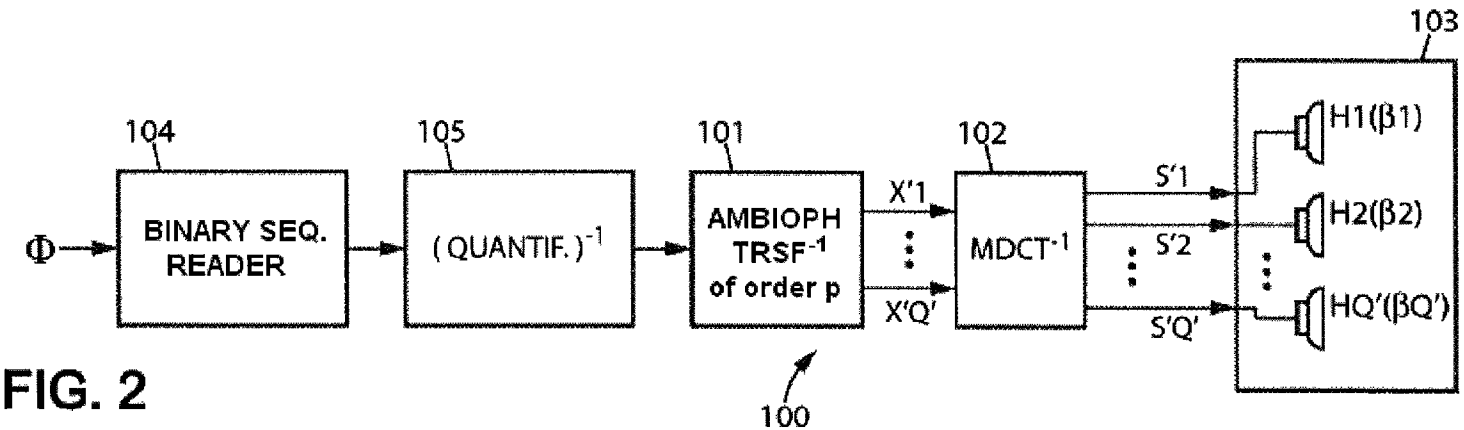
FIG. 2 represents a decoder in an embodiment of the invention.

FIG. 2 represents an audio decoder 100 in an embodiment of the invention.

The decoder 100 comprises a binary sequence reading module 104, an inverse quantification module 105, an inverse ambisonic transformation module 101, and a frequency/time transformation module 102.

The decoder 100 is suited to receiving at the input the bitstream ϕ transmitted by the encoder 1 and for delivering at the output Q' signals S'1, S'2, . . . , S'Q' intended to feed the respective Q' speakers H1, H2 . . . , HQ' of a sound rendering system 103.

Each speaker Hi, i=1 to Q', is associated with an angle βi indicating the angle of acoustic propagation from the speaker.

Operations Carried Out at the Level of the Encoder:

The time/frequency transformation module 3 of the encoder 1 receives at its input the N signals S1 . . . , SN of the 3D sound scene to be encoded.

Each signal Si, i=1 to N, is represented by the variation in its acoustic omnidirectional pressure Pi and the angle θi of propagation of the acoustic wave in the space of the 3D scene.

Over each time frame of each of these signals indicating the different values taken over time by the acoustic pressure Pi, the time/frequency transformation module 3 carries out a time/frequency transformation, in the present case, a modified discrete cosine transform (MDCT).

Thus it determines, for each of the signals Si, i=1 to N, its spectral representation Xi, characterized by M MDCT coefficients X(i, j), with j=0 to M−1. An MDCT coefficient X(i,j) thus represents the spectrum of the signal Si for the frequency band Fj.

The spectral representations Xi of the signals Si, i=1 to N, are supplied at the input of the spatial transformation module 4, which also receives at its input the acoustic propagation angles θi characterizing the input signals Si.

The spectral representations Xi of the signals Si, i=1 to N, are also supplied at the input of the masking curve calculation module 7.

The masking curve calculation module 7 is suited to determining the spectral masking curve of each signal Si considered individually, using its spectral representation Xi and a psychoacoustic model, which provides a masking level for each frequency band Fj, j=0 to M−1 of each spectral representation Xi. The definition elements of these masking curves are delivered to the module 5 for definition of the least relevant elements to be encoded.

The spatial transformation module 4 is suited to carrying out a spatial transformation of the input signals supplied, i.e. determining the spatial components of these signals resulting from the projection on a spatial reference system dependent on the order of the transformation. The order of a spatial transformation is associated with the angular frequency at which it "scans" the sound field.

In an embodiment, the spatial transformation module 4 carries out an ambisonic transformation, which gives a compact spatial representation of a 3D sound scene, by producing projections of the sound field on the associated spherical or cylindrical harmonic functions.

For more information on ambisonic transformations, reference can be made to the following documents: "Représentation de champs acoustiques, application à la transmission et à la reproduction de scènes sonores complexes dans un contexte multimédia ["Representation of acoustic fields, application to the transmission and reproduction of complex sound scenes in a multimedia context"], Doctoral Thesis of the University of Paris 6, Jerôme DANIEL, 31 Jul. 2001, "A highly scalable spherical microphone array based on an orthonormal decomposition of the sound field", Jens Meyer—Gary Elko, Vol. II-pp. 1781-1784 in Proc. ICASSP 2002.

Figure 3:
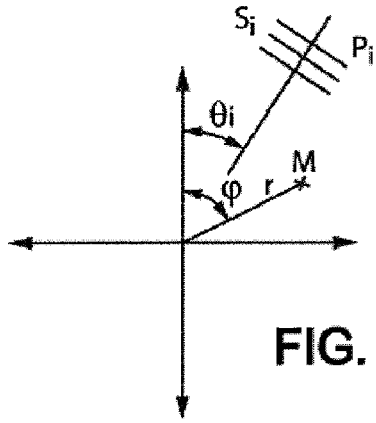
FIG. 3 illustrates the propagation of a plane wave in space.

With reference to FIG. 3, the following formula gives the decomposition into cylindrical harmonics in an infinite order of a signal Si of the sound scene:

$$Si(r,\varphi) + Pi\cdot\left[J_0(kr) + \sum_{1\le m\le\infty} 2\cdot j^m J_m(kr)\cdot\begin{pmatrix}\cos m\cdot\theta i\cdot\cos m\cdot\varphi + \\ \sin m\cdot\theta i\cdot\sin m\cdot\varphi\end{pmatrix}\right]$$

where ($J_m$) represent the Bessel functions, r the distance between the centre of the frame and the position of a listener placed at a point M, Pi the acoustic pressure of the signal Si, θi the propagation angle of the acoustic wave corresponding to the signal Si and ϕ the angle between the position of the listener and the axis of the frame.

If the ambisonic transformation is of order p (p being any positive integer), for a 2D ambisonic transformation (in the horizontal plane), the ambisonic transform of a signal Si expressed in the time domain then comprises the following 2p+1 components:

(Pi, Pi. cos θi, Pi. sin θi, Pi. cos 2θi, Pi. sin 2θi, Pi. cos 3θi, Pi. sin 3θi, . . . , Pi. cos pθi, Pi. sin pθi).

In the following, a 2D ambisonic transformation has been considered. Nevertheless the invention can be implemented with a 3D ambisonic transformation (in such a case, it is considered that the speakers are arranged on a sphere).

The ambisonic components Ak, k=1 to Q=2p+1, considered in the frequency domain, each comprises M spectral parameters A(k,j), j=0 to M−1 associated respectively with the Fj bands such that:

if A is the matrix comprising the components Ak, k=1 to Q resulting from the ambisonic transformation of order p of the signals Si, i=1 to N, Amb(p) is the ambisonic transformation matrix of order p for the spatial sound scene, and X is the matrix of the frequency components of the signals Si, i=1 to N, then:

$$\underline{A} = \begin{bmatrix} A(1,0) & A(1,1) & \dots & A(1,M-1) \\ A(2,0) & & & A(2,M-1) \\ \vdots & & & \vdots \\ A(Q,0) & A(Q,1) & \dots & A(Q,M-1) \end{bmatrix}$$

Amb(p)=[Amb(p)(i, j)], with i=1 to Q and j=1 to N, with: Amb(p)(1, j)=1, $$Amb(p)(i,j) = \sqrt{2}\cos\left[\left(\frac{i}{2}\right)\theta_j\right]$$

if i is even and $$Amb(p)(i,j) = \sqrt{2}\sin\left[\left(\frac{i-1}{2}\right)\theta_j\right]$$

if i is odd, i.e.

$$\underline{Amb(p)} = \begin{bmatrix} 1 & 1 & \dots & 1 \\ \sqrt{2}\cos\theta_1 & \sqrt{2}\cos\theta_2 & \dots & \sqrt{2}\cos\theta_N \\ \sqrt{2}\sin\theta_1 & \sqrt{2}\sin\theta_2 & \dots & \sqrt{2}\sin\theta_N \\ \sqrt{2}\cos 2\theta_1 & \sqrt{2}\cos 2\theta_2 & \dots & \sqrt{2}\cos 2\theta_N \\ \sqrt{2}\sin 2\theta_1 & \sqrt{2}\sin 2\theta_2 & \dots & \sqrt{2}\sin 2\theta_N \\ & & \dots & \\ & & \dots & \\ \sqrt{2}\cos p\theta_1 & \sqrt{2}\cos p\theta_2 & \dots & \sqrt{2}\cos p\theta_N \\ \sqrt{2}\sin p\theta_1 & \sqrt{2}\sin p\theta_2 & \dots & \sqrt{2}\sin p\theta_N \end{bmatrix} \quad \text{Equation (1)}$$

$$\text{and } \underline{X} = \begin{bmatrix} X(1,0) & X(1,1) & \dots & X(1,M-1) \\ X(2,0) & X(2,1) & \dots & X(2,M-1) \\ \vdots & & & \vdots \\ X(N,0) & \dots & \dots & X(N,M-1) \end{bmatrix}$$

and we have $\underline{A} = \underline{Amb(p)} \times \underline{X}$.

The spatial transformation module 4 is suited to determining the matrix A, using equation (1) as a function of the data X(i, j) and θi (i=1 to N, j=0 to M−1) which are supplied to it at the input.

In the particular case considered, the ambisonic components Ak, k=1 to Q, i.e. the parameters A(k, j), k=1 to Q and j=0 to M−1, of this matrix A, are the elements to be encoded by the encoder 1 in a binary sequence.

The ambisonic components Ak, k=1 to Q, are delivered to the module 5 for definition of the least relevant elements for quantification and determination of a sequencing of the ambisonic components.

This module 5 for definition of the least relevant elements is suited to implementation of the operations, following the execution on processing means of the module 5, of a first algorithm and/or a second algorithm, with a view to defining the least relevant elements to be encoded and sequencing the elements to be encoded with each other.

This sequencing of the elements to be encoded is used subsequently during the constitution of a binary sequence to be transmitted.

The first algorithm comprises instructions suitable for implementation, when they are executed on the processing means of the module 5, of the steps of the process Proc1 described below with reference to FIG. 4.

Process Proc1

The principle of the process Proc1 is as follows: a calculation is made of the respective influence of at least some spectral components which can be calculated as a function of spectral parameters originating from at least some of the N signals, on mask-to-noise ratios determined over the spectral bands as a function of an encoding of said spectral components. Then an order of priority is allocated to at least one spectral component as a function of the influence calculated for said spectral component compared to the other calculated influences.

In an embodiment, the detailed process Proc1 is as follows:

Initialization

Step 1*a:*

In this step, a first rate $D_0=D_{max}$ and an allocation of parts of this rate $D_0$ between the elements to be encoded A(k, j), (k, j)$\epsilon E_0$={(k, j) such that k=1 to Q and j=0 to M−1} are defined. The rate allocated to the element to be encoded A(k, j), (k, j)$\epsilon E_0$ during this allocation (the sum of these rates $d_{k,j|k=1\ to\ Q, j=0\ to\ M-1}$ is equal to $D_0$) is named $d_{k,j}$ and $\delta_0$=min $d_{k,j}$ for (k, j)$\epsilon E_0$.

Then the elements to be encoded A(k, j), (k, j)$\epsilon E_0$, are quantified by the quantification module 10 as a function of the allocation defined for the rate $D_0$.

Step 1*b:*

Then, the ratio of the mask to the quantification error (or noise) ("Mask to noise Ratio" or MNR) is calculated for each signal Si and for each sub-band Fj, with i=1 to N and j=0 to M−1, which is equal to the power of the mask of the signal Si in the band Fj divided by the power of the quantification noise (E(i,j)) relating to the signal Si in this band Fj.

In order to do this, the quantification error b(k,j) in each band Fj of the elements to be encoded A(k,j), (k, j)$\epsilon E_0$, is first determined as follows:

b(k, j)=A(k, j)−$\overline{A}$(k, j), with $\overline{A}$(k, j) being the result of the quantification, then inverse quantification of the element A(k, j) (in general the quantification provides a quantification index indicating the value of the element quantified in a dictionary, the inverse quantifier provides the value of the element quantified as a function of the index).

Then the quantification error E(i, j) in each band Fj for each signal Si with i=1 to N and j=0 to M−1 is determined, due to the quantification of the elements to be encoded according to the rate $D_0$, by calculating the matrix $\underline{E}$ comprising the elements E (i, j):

$$\underline{E} = \frac{1}{Q^2}(Amb(p)\cdot Amb(p)^t)^{-1}\cdot \underline{Amb(p)^t}\cdot \underline{B}, \qquad \text{Equation (2)}$$

where Q=2p+1, Amb(p) is the ambisonic transformation matrix of order p and $$\underline{E} = \begin{bmatrix} E(1,0) & E(1,1) & \dots & E(1,M-1) \\ E(2,0) & E(2,1) & \dots & E(2,M-1) \\ \vdots & & & \vdots \\ E(N,0) & \dots & \dots & E(N,M-1) \end{bmatrix} = [E(i,j)]_{i=1\ to\ N, j=0\ to\ M-1} \text{ and}$$

$$\underline{B} = \begin{bmatrix} b(1,0) & b(1,1) & \dots & b(1,M-1) \\ b(2,0) & & & b(2,M-1) \\ \vdots & & & \vdots \\ b(Q,0) & b(Q,1) & \dots & b(Q,M-1) \end{bmatrix} = [b(k,j)]_{k=1\ to\ Q, j=0\ to\ M-1}.$$

Then, the ratio of the mask to the quantification error for each signal Si and for each band Fj, with i=1 to N and j=0 to M−1 is determined as a function of the quantification noise E(i, j) thus calculated relative to the signal Si in this band Fj and of the mask of the signal Si in the band Fj provided by the mask calculation module 7.

MNR(0, $D_0$) refers to the matrix such that the element (i, j) of the matrix MNR (0,$D_0$), i=1 to N and j=0 to M−1, indicates the ratio of the mask to the quantification error for the signal Si and for the band Fj for the quantification previously carried out.

Before describing iteration No. 1 of the process Proc1, an indication is given below of how equation (2) was determined.

Figure 8:
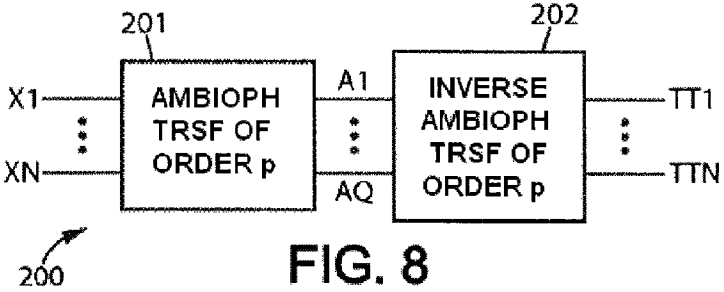
FIG. 8 represents a processing chain.

FIG. 8 represents a processing chain 200 comprising an ambisonic transformation module 201 of order p (similar to the module 4 of ambisonic transformation of order p of FIG. 1) followed by an inverse ambisonic transformation module 202 of order p. The ambisonic transformation module 201 of order p receives at the input the spectral representations X1 . . . , XN of the signals S1, . . . , SN, carries out on these signals an ambisonic transformation of order p, delivers the ambisonic signals obtained, A1 to AQ, to the inverse ambisonic transformation module 202 of order Q, which delivers N respective acoustic pressure signals Πi, i=1 to N.

We then have $$\begin{pmatrix} \Pi 1 \\ \Pi 2 \\ \\ \Pi N \end{pmatrix} = AmbInv(p)\times Amb(p)\times \begin{pmatrix} X1 \\ X2 \\ \\ XN \end{pmatrix},$$

where Amb(p) is the ambisonic transformation matrix of order p and AmbInv(p) is the inverse ambisonic transformation matrix of order p (also called the ambisonic decoding matrix).

Figure 9:
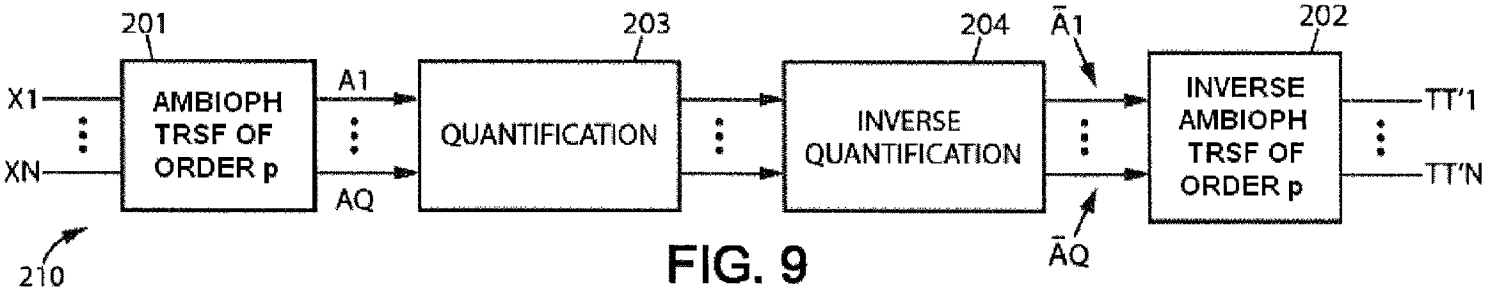
FIG. 9 comprises a second processing chain.

FIG. 9 represents a processing chain 210 comprising the ambisonic transformation module 201 of order p followed by a quantification module 203, then an inverse quantification module 204, and an inverse ambisonic transformation module 202 of order p. The ambisonic transformation module 201 of order p at the input of the processing chain 210 receives at the input the spectral representations X1 . . . , XN of the signals S1, . . . , SN and delivers the ambisonic signals obtained, A1 to AQ, which are supplied at the input of the quantification module 203. The signals $\overline{A}$1, . . . , $\overline{A}$Q are the signals delivered to the inverse ambisonic transformation module 202 by the inverse quantification module 204, resulting from the inverse quantification carried out on the signals delivered by the quantification module 203. The inverse ambisonic transformation module 202 of order Q delivers N respective acoustic pressure signals Π'i, i=1 to N.

Figure 10:
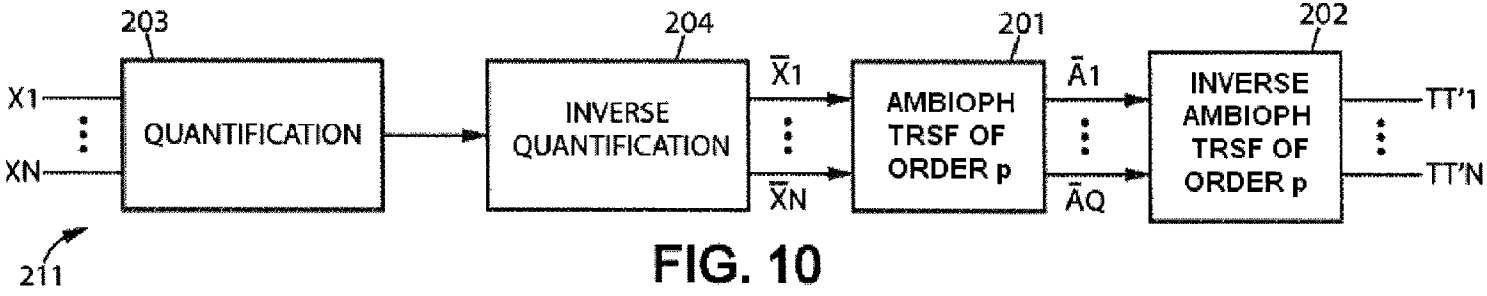
FIG. 10 represents a third processing chain.

The processing chain 210 of FIG. 9 provides the same output acoustic pressures Π'i as the processing chain 211 represented in FIG. 10, in which the ambisonic transformation module 201 of order p is situated between the inverse quantification module 204 and the inverse ambisonic transformation module 202 of order p. In the processing chain 211, the quantification module 203 at the input of the processing chain 211 receives at the input the spectral representations X1, . . . , XN, quantifies them then delivers the result of this quantification to the inverse quantification module 204, which delivers the N signals $\overline{X}$1, . . . , $\overline{X}$N. These signals X1, . . . , $\overline{X}$N are then supplied to the ambisonic transformation and inverse ambisonic transformation modules 201 and 202 arranged in a cascade. The inverse ambisonic transformation module 202 of order p delivers the N respective acoustic pressure signals Π'i, i=1 to N.

We can then write:

$$\begin{pmatrix} \Pi' 1 \\ \Pi' 2 \\ \\ \Pi' N \end{pmatrix} = AmbInv(p)\times Amb(p)\times \begin{pmatrix} \overline{X}1 \\ \overline{X}2 \\ \\ \overline{X}N \end{pmatrix}$$

-continued $$\begin{pmatrix} \Pi'1 \\ \Pi'2 \\ \\ \Pi'N \end{pmatrix} - \begin{pmatrix} \Pi1 \\ \Pi2 \\ \\ \Pi N \end{pmatrix} = AmbInv(p) \times Amb(p) \times \left( \begin{pmatrix} \overline{X}1 \\ \overline{X}2 \\ \\ \overline{X}N \end{pmatrix} - \begin{pmatrix} X1 \\ X2 \\ \\ XN \end{pmatrix} \right)$$

$$= AmbInv(p) \times Amb(p) \times \underline{E}.$$

$$\text{Let } \underline{E} = (AmbInv(p) \times Amb(p))^{-1} \left( \begin{pmatrix} \Pi'1 \\ \Pi'2 \\ \\ \Pi'N \end{pmatrix} - \begin{pmatrix} \Pi1 \\ \Pi2 \\ \\ \Pi N \end{pmatrix} \right).$$

$$\text{Moreover, } \begin{pmatrix} \Pi'1 \\ \Pi'2 \\ \\ \Pi'N \end{pmatrix} - \begin{pmatrix} \Pi1 \\ \Pi2 \\ \\ \Pi N \end{pmatrix} = AmbInv(p) \times \left( \begin{pmatrix} \overline{A}1 \\ \overline{A}2 \\ \\ \overline{A}Q \end{pmatrix} - \begin{pmatrix} A1 \\ A2 \\ \\ AQ \end{pmatrix} \right)$$

$$= AmbInv(p) \times \underline{B}.$$

Therefore we deduce from this: $E=(AmbInv(p)\times Amb(p))^{-1}$ $AmbInv(p)\times\underline{B}$. In the case where the ambisonic decoding matrix corresponds to a system with regular speakers, we have $$AmbInv(p) = \frac{1}{N} Amb(p)^t$$

(in fact, the N quantification errors $\underline{E}$ or $\underline{B}$ depend only on the encoding carried out and not on the decoding. What will change at the level of the decoding, as a function of the decoding matrix used, corresponding to the system of speakers used, is the way in which the error is distributed between the speakers. This is due to the fact that the psychoacoustics used do not take into account the interactions between the signals. Therefore if the calculation is carried out for a well-defined decoding matrix and the quantification module optimizes the error for this matrix, then for the other decoding matrices the error is sub-optimum).

Equation (2) is therefore deduced from it.

Figure 4B:
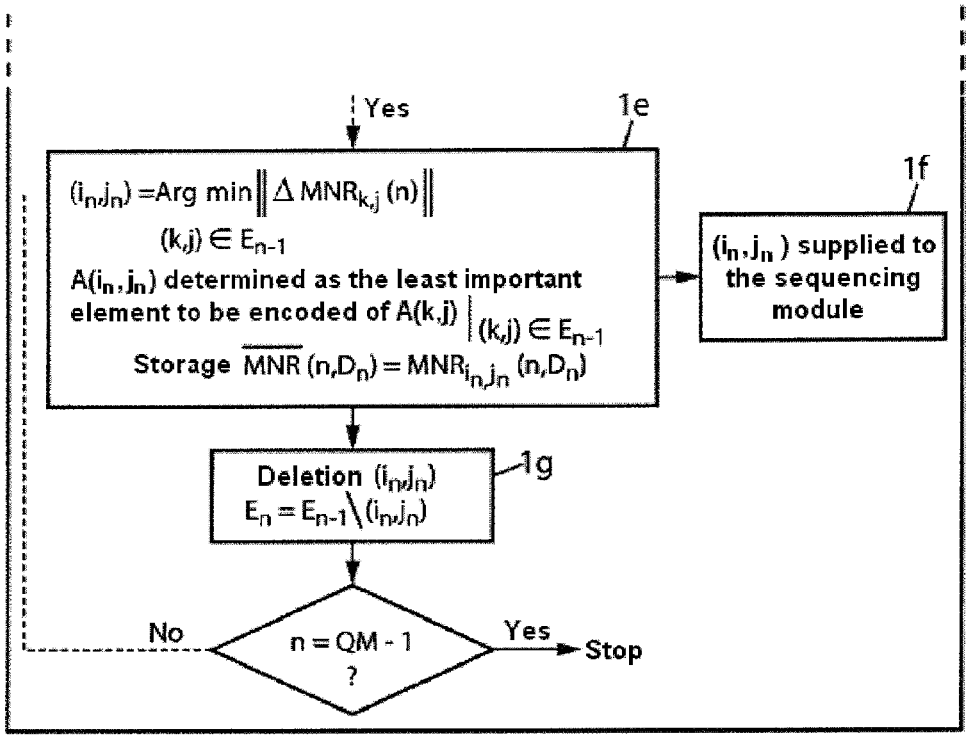
FIG. 4 is a flowchart representing steps of a first process Proc1 in an embodiment of the invention.
Figure 4A:
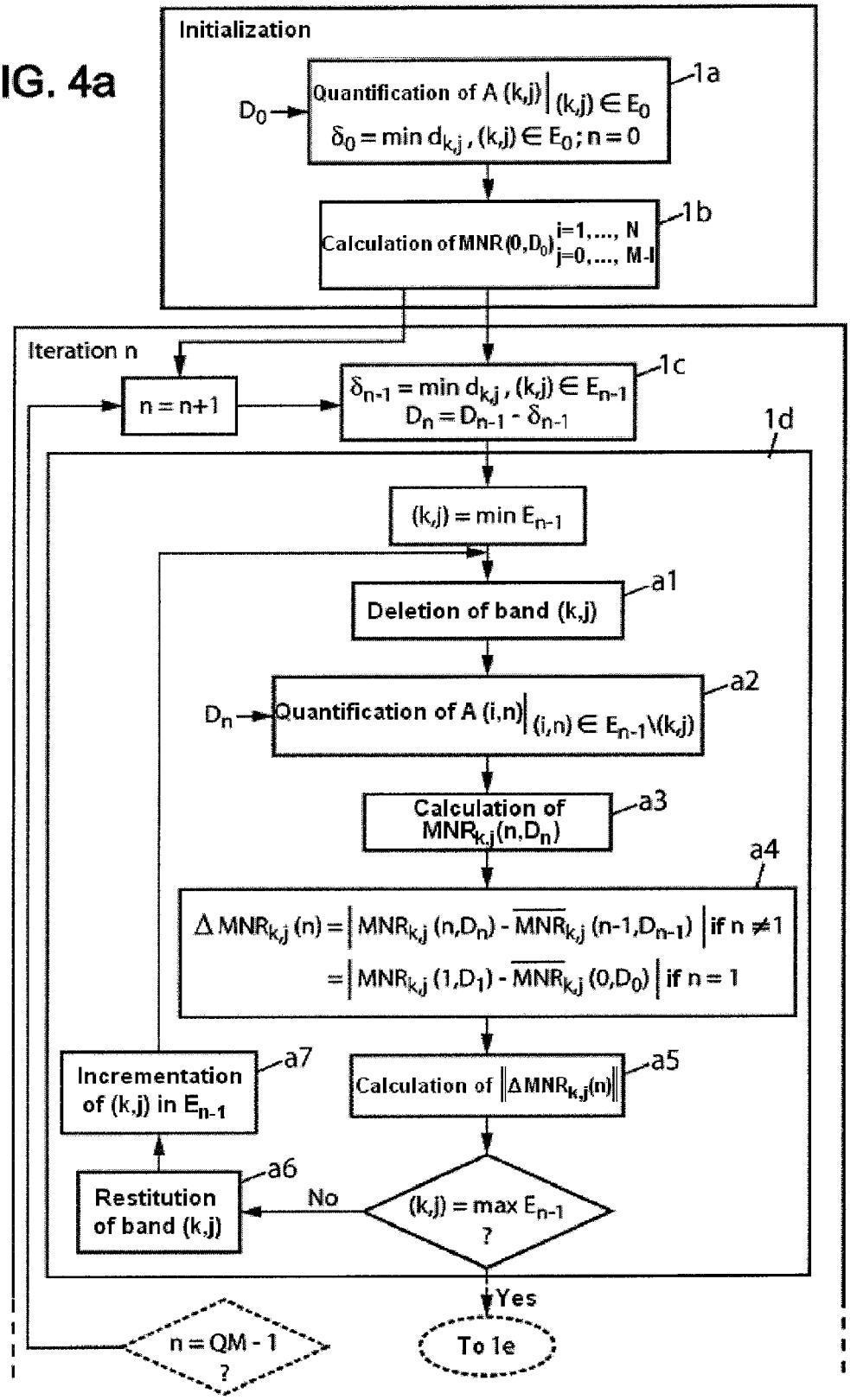

To return to the description of FIG. 4.

Iteration No. 1:

Step 1*c:*

A second encoding rate $D_1$ is now defined, with $D_1=D_0-\delta_0$, and a distribution of this encoding rate $D_1$ between the elements to be encoded A(k, j), k=1 to Q and j=0 to M−1.

Step 1*d:*

Then, for each pair $(k, j)\in E_0$, considered successively from the pair (1.0) up to the pair (Q,M−1) according to the order of lexicographical reading of the pairs of $E_0$, the following operations a1 to a7 are reiterated:

a1—it is considered that the sub-band (k, j) is deleted for operations a2 to a5;

a2—the elements to be encoded A(i,n), with $(i,n)\in E_0\backslash(k, j)$ (i.e. (i,n) equal to each of the pairs of $E_0$ with the exception of the pair (k, j)) are quantified by the quantification module 10 as a function of a defined distribution of the rate Di between said elements to be encoded A(i,n), with $(i,n)\in E_0\backslash(k, j)$;

a3—in the same way as that indicated in step 1*b*, based on the elements $\overline{A}(i,n)\in E_0\backslash(k, j)$ resulting from the quantification operations carried out in step a2, the matrix $MNR_{k,j}(1,D_1)=[MNR_{k,j}(1,D_1)(i, t)]_{i=1\ to\ N\ and\ t=0\ to\ M-1}$ is calculated such that each element $MNR_{k,j}(1,D_1)$ (i, t) of the matrix indicates the ratio of the mask to the quantification error (or noise) for each signal Si and for each sub-band Ft, with i=1 to N and t=0 to M−1 following the quantification carried out in step a2 (the sub-band (k, j) being considered as deleted, the quantification noise b(k, j) has been considered as zero in the calculations). The values taken by the elements of this matrix $MNR_{k,j}(1,D_1)$ are stored;

a4—then, the matrix $\Delta MNR_{k,j}(1)$ of variation in the ratio of the mask to the quantification error $\Delta MNR_{k,j}(1)=|MNR_{k,j}(1, D_1)-\overline{MNR}_{k,j}(0,D_0)|$ is calculated and stored; with $\overline{MNR}_{k,j}(0,D_0)$ being the matrix $MNR(0,D_0)$ from which the index element (k, j) has been deleted a5—a norm $\|\Delta MNR_{k,j}(1)\|$ of this matrix $\Delta MNR_{k,j}(1)$ is calculated. The value of this norm evaluates the impact on the set of signal to noise ratios of the signals Si, of the deletion of the component A(k, j) among the elements to be encoded A(i,n), with $(i,n)\in E_0$.

The norm calculated makes it possible to measure the difference between $MNR_{k,j}(1,D_1)$ and $\overline{MNR}_{k,j}(0,D_0)$ and is for example equal to the square root of the sum of each element of the matrix $\Delta MNR_{k,j}(1)$ squared.

a6—it is considered that the sub-band (k, j) is no longer deleted;

a7—if (k, j)≠max $E_0$=(Q,M−1), the pair (k, j) is incremented in $E_0$ and steps a1 to a7 are reiterated until max $E_0$ is reached.

Step 1*e:*

$(i_1, j_1)$ is determined, corresponding to the smallest value among the values $\|\Delta MNR_{k,j}(1)\|$, obtained for $(k,j)\in E_0$, i.e.:

$$(i_1, j_1) = \arg\min_{(k,j)\in E_0} \|\Delta MNR_{k,j}(1)\|.$$

The element to be encoded $A(i_1, j_1)$ is thus identified as the least relevant element as regards the overall audio quality among the set of elements to be encoded A(i, j) with $(i, j)\in E_0$.

Step 1*f:*

The identifier of the pair $(i_1, j_1)$ is delivered to the sequencing module 6 as result of the first iteration of the process Proc1.

Step 1*g:*

The band $(i_1, j_1)$ is then deleted from the set of elements to be encoded in the remainder of the process Proc1. The set $E_1=E_0\backslash\{(i_1, j_1)\}$ is defined.

Iteration 2 and Following:

Steps similar to steps 1*c* to 1*g* are carried out for each iteration n, n≧2, as described hereafter.

Step 1*c*: an (n+1)th encoding rate $D_n$ is now defined, with $D_n=D_{n-1}-\delta_{n-1}$ such that $\delta_{n-1}=\min(d_{ij})$, for $(i, j)\in E_{n-1}$.

Step 1*d*: then, for each pair $(k, j)\in E_{n-1}$ and considered successively in lexicographical order, the following operations a1 to a7 are reiterated:

a1—it is considered that the sub-band (k, j) is deleted in operations a2 to a5;

a2—the elements to be encoded A(i,n), with $(i,n)\in E_{n-1}\backslash\{(k,j)\}$ are quantified by the quantification module 10 as a function of a distribution of the rate $D_n$ between the elements to be encoded A(i,n), with $(i,n)\in E_{n-1}\backslash\{(k, j)\}$;

a3—based on the elements $\overline{A}(i,n)$, $(i,n)\in E_{n-1}\backslash\{(k, j)\}$ determined as a function of the quantification in step a2, the matrix $MNR_{k,j}(n, D_n)$ is calculated, indicating the ratio of the mask to the quantification error (or noise) for each signal Si and for each sub-band Fj, with i=1 to N and j=0 to M−1, following the quantification carried out in step a2;

a4—then the matrix of variation in the ratio of the mask to the quantification error $\Delta MNR_{k,j}(n)=|MNR_{k,j}(n,D_n)-\overline{MNR}_{k,j}(n-1, D_{n-1})|$, with $\overline{MNR}_{k,j}(n-1, D_{n-1})$ corresponding to the matrix $\overline{MNR}(n-1, D_{n-1})$ from which the index element (k, j) has been deleted, and a norm $\|\Delta MNR_{k,j}(n)\|$ of this matrix $\Delta MNR_{k,j}(n)$ is calculated and stored. The value of this norm evaluates the impact, on the set of signal-to-noise ratios of the signals Si, of the deletion of the component A(k, j) among the elements to be encoded A(i,n), with $(i,n)\epsilon E_{n-1}\backslash\{(k,j)\}$.

a5—it is considered that the sub-band (k, j) is no longer deleted;

a6—if $(k, j)\neq \max E_{n-1}$, the pair (k, j) is incremented in $E_{n-1}$ and steps a1 to a6 are reiterated until max $E_{n-1}$ is reached.

Step 1*e*: $(i_n, j_n)$ is determined, corresponding to the smallest value among the values obtained $\|\Delta MNR_{k,j}(n)\|$, for (k,j) $\epsilon E_{n-1}$, i.e.

$$(i_n, j_n) = \arg \min_{(k,j)\in E_{n-1}} \|\Delta MNR_{k,j}(n)\|.$$

The matrix $\overline{MNR}(n,D_n)=MNR_{i_n,j_n}(n, D_n)$ is also stored.

The element to be encoded $A(i_n, j_n)$ is thus identified as the least relevant element as regards the overall audio quality among the set of elements to be encoded A(l, j), such that $(i, j)\epsilon E_{n-1}$.

Step 1*f*: the identifier of the pair $(i_n, j_n)$ is delivered to the sequencing module 6 as a result of the nth iteration of the process Proc1.

Step 1*g*: then the band $(i_n, j_n)$, is deleted from the set of elements to be encoded in the remainder of the process Proc1. The set $E_n=E_{n-1}\backslash\{(i_n, j_n)\}$ is defined.

The process Proc1 is reiterated r times and a maximum of Q*M−1 times.

Priority indices are thus then allocated by the sequencing module 6 to the different frequency bands, with a view to the insertion of the encoding data into a binary sequence.

Sequencing of the elements to be encoded and constitution of a binary sequence based on the results successively provided by the successive iterations of the process Proc1:

In an embodiment where the sequencing of the elements to be encoded is carried out by the sequencing module 6 solely based on the results successively provided by the successive iterations of the process Proc1 implemented by the module 5 for definition of the least relevant elements to be encoded with the exclusion of the results provided by the process Proc2, the latter defines an order of said elements to be encoded, reflecting the importance of the elements to be encoded with respect to the overall audio quality.

Figure 5A:
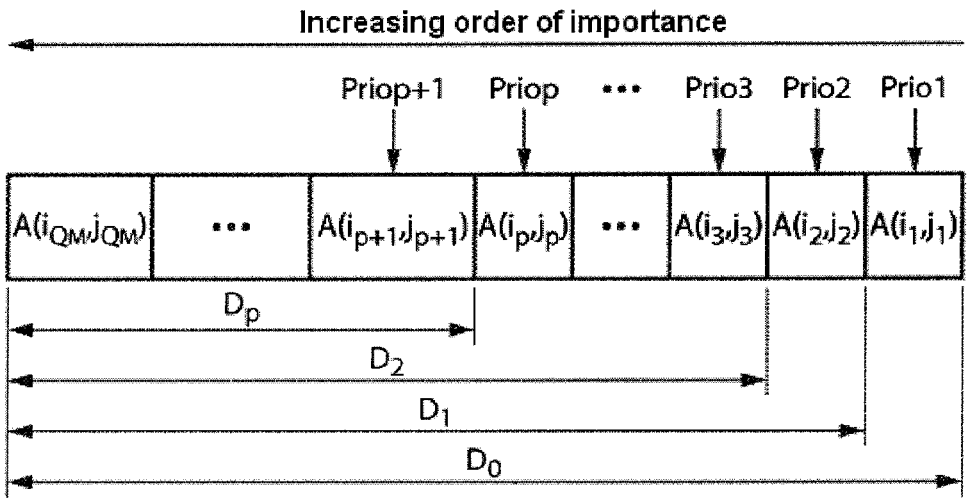
FIG. 5*a* represents a binary sequence constructed in an embodiment of the invention.

With reference to FIG. 5*a*, the element to be encoded $A(i_1, j_1)$ corresponding to the pair $(i_1, j_1)$ determined during the first iteration of Proc1 is considered the least relevant with respect to the overall audio quality. It is therefore assigned a minimum priority index Prio1 by the module 5.

The element to be encoded $A(i_2, j_2)$, corresponding to the pair $(i_2, j_2)$ determined during the second iteration of Proc1, is considered as the least relevant element to be encoded with respect to the overall audio quality, after that assigned with priority Prio1. It is therefore assigned a minimum priority index Prio2, with Prio2>Prio1. When the iteration number r of the process is strictly less than Q*M−1, the sequencing module 6 thus successively schedules r elements to be encoded each assigned to increasing priority indexes Prio1, Prio2 to Prio r. The elements to be encoded not having been assigned an order of priority during an iteration of the process Proc1 are more important with respect to the overall audio quality than the elements to be encoded to which orders of priority have been assigned.

When r is equal to Q*M−1 times, all the elements to be encoded are sequenced one by one.

In the following, it is considered that the number of iterations r of the process Proc1 carried out is equal to Q*M−1 times.

The order of priority assigned to an element to be encoded A(k, j) is also assigned to the encoded element $\overline{A}(k, j)$ resulting from a quantification of this element to be encoded.

The module 8 for constitution of the binary sequence constitutes a binary sequence corresponding to a frame of each of the signals Si, i=1 to N by successively integrating encoded elements $\overline{A}(k, j)$ into it in decreasing order of assigned priority indices, the binary sequence being to be transmitted in the bitstream $\phi$.

Thus the binary sequence constituted is sequenced according to the sequencing carried out by the module 6.

The binary sequence is thus constituted by spectral components associated with respective spectral bands, of elements to be encoded originating from an audio scene comprising N signals with N>1, and which are sequenced as a function of their influence on mask-to-noise ratios determined on the spectral bands.

The spectral components of the binary sequence are for example sequenced according to the method of the invention.

In an embodiment, only some of the spectral components comprised within the binary sequence constituted are sequenced using a method according to the invention.

In the embodiment considered above, a deletion of a spectral component from a element to be encoded A(i, j) takes place upon each iteration of the algorithm Proc1.

In another embodiment, an imbricated quantifier is used for the quantification operations. In such a case, the spectral component of an identified element to be encoded $A(i_0, j_0)$ is not deleted, but a reduced rate is assigned to the encoding of this component with respect to the encoding of the other spectral components of elements to be encoded remaining to be sequenced.

The encoder 1 is thus an encoder allowing a rate adaptability taking into account the interactions between the different monophonic signals. It allows definition of compressed data optimizing the perceived overall audio quality.

The operations of sequencing the elements of the binary sequence and constitution of the binary sequence using the process Proc1 have been described above for an embodiment of the invention in which the elements to be encoded comprise the ambisonic components of the signals.

In another embodiment, an encoder according to the invention does not encode these ambisonic components, but the spectral coefficients X(i,j), j=0 to M, of the signals Si.

In such a case, at the first iteration of the process 1 for example a minimum priority index (minimum among the elements remaining to be sequenced) is assigned to the element to be encoded $X(i_1, j_1)$ such that the deletion of the spectral component $X(i_1, j_1)$ gives rise to a minimum variation in the mask-to-noise ratio. Then the process Proc1 is reiterated.

Process Proc2

The Gerzon criteria are generally used to characterize the locating of the virtual sound sources synthesized by the restitution of signals from the speakers of a given sound rendering system.

These criteria are based on the study of the velocity and energy vectors of the acoustic pressures generated by a sound rendering system used.

When a sound rendering system comprises L speakers, the signals, i=1 to L, generated by these speakers, are defined by an acoustic pressure Ti and an acoustic propagation angle $\xi_i$.

The velocity vector $\vec{V}$ is then defined thus:

$$\vec{V} = \begin{cases} x_V = \dfrac{\sum_{1\le i\le L} Ti\cos\xi_i}{\sum_{1\le i\le L} Ti} \\ y_V = \dfrac{\sum_{1\le i\le L} Ti\sin\xi_i}{\sum_{1\le i\le L} Ti} \end{cases}$$

A pair of polar coordinates exists ($r_V$, $\xi_V$) such that:

$$\vec{V} = \begin{cases} x_V = \dfrac{\sum_{1\le i\le L} Ti\cos\xi_i}{\sum_{1\le i\le L} Ti} = r_V\cos\xi_V \\ y_V = \dfrac{\sum_{1\le i\le L} Ti\sin\xi_i}{\sum_{1\le i\le L} Ti} = r_V\sin\xi_V \end{cases} \quad \text{Equation (3)}$$

The energy vector $\vec{E}$ is defined thus:

$$\vec{E} = \begin{cases} x_E = \dfrac{\sum_{1\le i\le L} Ti^2\cos\xi_i}{\sum_{1\le i\le L} Ti^2} \\ y_E = \dfrac{\sum_{1\le i\le L} Ti^2\sin\xi_i}{\sum_{1\le i\le L} Ti^2} \end{cases}$$

A pair of polar coordinates exists ($r_E$, $\xi_E$) such that:

$$\vec{E} = \begin{cases} x_E = \dfrac{\sum_{1\le i\le L} Ti^2\cos\xi_i}{\sum_{1\le i\le L} Ti^2} = r_E\cos\xi_E \\ y_E = \dfrac{\sum_{1\le i\le L} Ti^2\sin\xi_i}{\sum_{1\le i\le L} Ti^2} = r_E\sin\xi_E \end{cases} \quad \text{Equation (4)}$$

The conditions necessary for the locating of the virtual sound sources to be optimum are defined by seeking the angles $\xi_i$, characterizing the position of the speakers of the sound rendering system considered, verifying the criteria below, said Gerzon criteria, which are:

- criterion 1, relating to the precision of the sound image of the source S at low frequencies: $\xi_V=\xi$; where $\xi$ is the angle of propagation of the real source S which it is sought to attain.
- criterion 2, relating to the stability of the sound image of the source S at low frequencies: $r_V=1$;
- criterion 3, relating to the precision of the sound image of the source S at high frequencies: $\xi_E=\xi$;
- criterion 4, relating to the stability of the sound image of the source S at high frequencies: $r_E=1$.

The operations described below in an embodiment of the invention use the Gerzon vectors in an application other than that which involves seeking the best angles $\xi_i$, characterizing the position of the speakers of the sound rendering system considered.

The Gerzon criteria are based on the study of the velocity and energy vectors of the acoustic pressures generated by a sound rendering system used.

Each of the coordinates $x_V$, $y_V$, $x_E$, $y_E$ indicated in equations 3 and 4 relating to the energy and velocity vectors associated with the Gerzon criteria is an element of [−1,1]. Therefore a single pair ($\xi_V$, $\xi_E$) exists verifying the following equations, corresponding to the perfect case ($r_V$, $r_E$)=(1,1):

$$\frac{\sum_{1\le i\le L} Ti\cos\xi_i}{\sum_{1\le i\le L} Ti} = \cos\xi_V,\ \frac{\sum_{1\le i\le L} Ti\sin\xi_i}{\sum_{1\le i\le L} Ti} = \sin\xi_V,$$

$$\frac{\sum_{1\le i\le L} Ti^2\cos\xi_i}{\sum_{1\le i\le L} Ti^2} = \cos\xi_E \text{ and } \frac{\sum_{1\le i\le L} Ti^2\sin\xi_i}{\sum_{1\le i\le L} Ti^2} = \sin\xi_E.$$

The angles $\xi_V$ and $\xi_E$ of this single pair are therefore defined by the following equations (equations (5)):

$$\xi_V = \text{sign}\left(\frac{\sum_{1\le i\le L} Ti\sin\xi_i}{\sum_{1\le i\le L} Ti}\right)\cdot\arccos\left(\frac{\sum_{1\le i\le L} Ti\cos\xi_i}{\sum_{1\le i\le L} Ti}\right)$$

$$\xi_E = \text{sign}\left(\frac{\sum_{1\le i\le L} Ti^2\sin\xi_i}{\sum_{1\le i\le L} Ti^2}\right)\cdot\arccos\left(\frac{\sum_{1\le i\le L} Ti^2\cos\xi_i}{\sum_{1\le i\le L} Ti^2}\right)$$

Hereafter the term generalized Gerzon angle vector will generally be used to refer to the vector $\vec{\xi}$ such that $$\vec{\xi} = \begin{pmatrix} \xi_V \\ \xi_E \end{pmatrix}.$$

Figure 6:
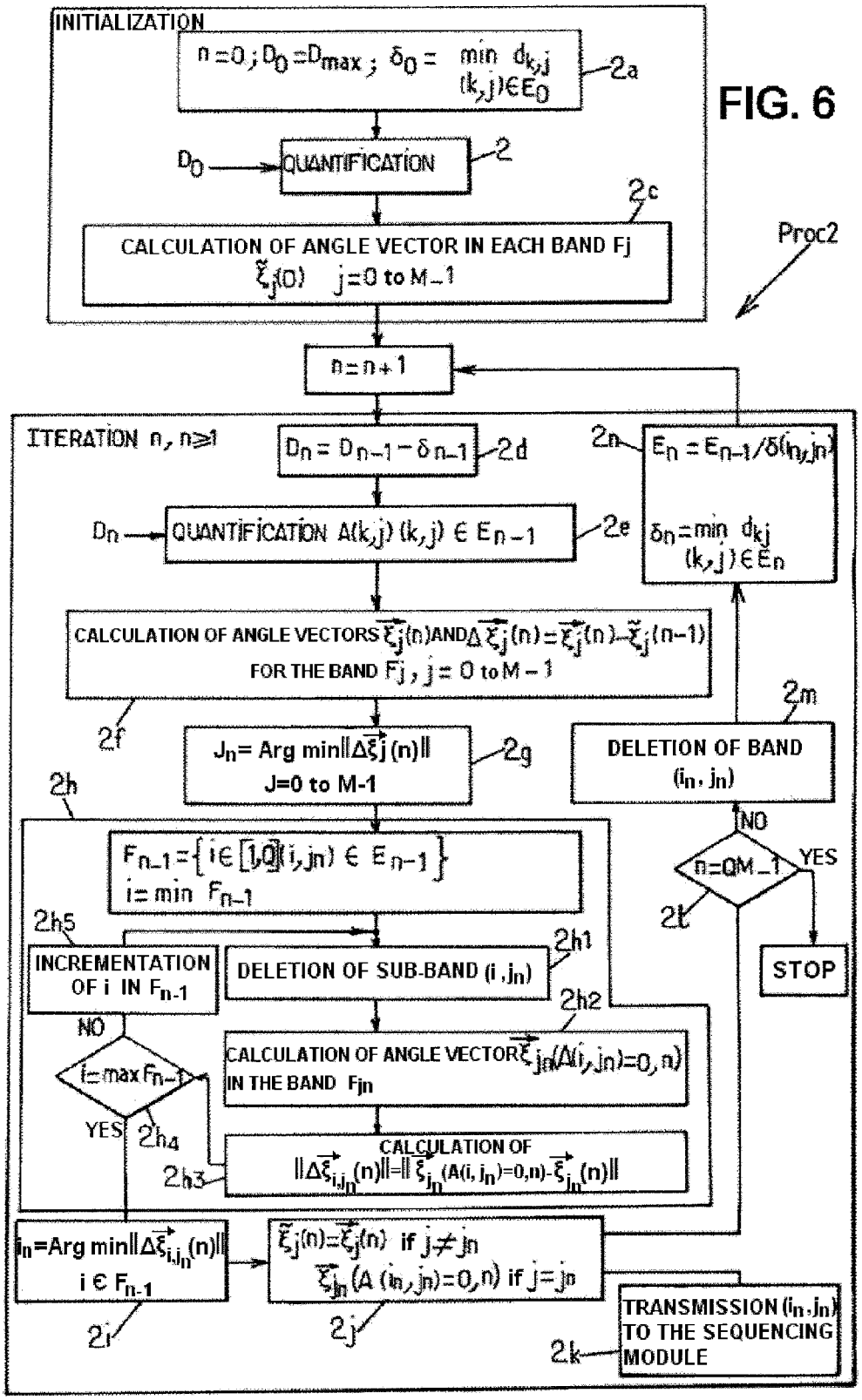
FIG. 6 is a flowchart representing steps of a second process Proc2 in an embodiment of the invention.

The second algorithm comprises instructions suited to implementing, when they are executed on processing means of the module 5, the steps of the process Proc2 described below with reference to FIG. 6.

The principle of the process Proc2 is as follows: a calculation is made of the influence of each spectral parameter, among a set of spectral parameters to be sequenced, on an angle vector defined as a function of energy and velocity vectors associated with Gerzon criteria and calculated as a function of an inverse ambisonic transformation on said quantified ambisonic components. Furthermore, an order of priority is allocated to at least one spectral parameter as a function of the influence calculated for said spectral parameter compared to the other influences calculated.

In an embodiment, the detailed process Proc2 is as follows:

Initialization (n=0)

Step 2*a:*

A rate $D_0=D_{max}$ and an allocation of this rate between the elements to be encoded A(k, j), for $(k,j)\in E_0=\{(k, j)$ such that k=1 to Q and j=0 to M−1$\}$ are defined.

The rate allocated to the element to be encoded A(k, j), $(k, j)\in E_0$, during this initial allocation is referred to as $d_{k,j}$ (the sum of these rates $d_{k,j|i=1\ to\ Q,\ j=0\ to\ M-1}$ is equal to $D_0$) and $\delta_0=\min d_{k,j}$, for $(k, j)\in E_0$.

Step 2*b:*

Then each element to be encoded A(k, j), (k, j)$\epsilon E_0$ is quantified by the quantification module 10 as a function of the rate $d_{k,j}$ which has been allocated to it in step 2*a*.

$\overline{A}$ is the matrix of the elements $\overline{A}$(k,j), k=1 to Q and j=0 to M−1. Each element $\overline{A}$(k,j) is the result of the quantification, with the rate $d_{k,j}$, of the parameter A(k, j), relative to the spectral band $F_j$, of the ambisonic component A(k). The element $\overline{A}$(k,j) therefore defines the quantified value of the spectral representation for the frequency band $F_j$, of the ambisonic component Ak considered.

$$\overline{A} = \begin{bmatrix} \overline{A}(1,0) & \overline{A}(1,1) & \dots & \overline{A}(1,M-1) \\ \overline{A}(2,0) & & & \overline{A}(2,M-1) \\ \vdots & & & \vdots \\ \overline{A}(Q,0) & \overline{A}(Q,1) & \dots & \overline{A}(Q,M-1) \end{bmatrix},$$

Step 2*c:*

Then, these quantified ambisonic components $\overline{A}$(k, j), k=1 to Q and j=0 to M−1, are subjected to ambisonic decoding of order p such that 2p+1=Q and which corresponds to a regular system of N speakers, in order to determine the acoustic pressures T1*i*, i=1 to N, of the N sound signals obtained as a result of this ambisonic decoding.

In the case considered, AmbInv(p) is the inverse ambisonic transformation matrix of order p (or ambisonic decoding of order p) delivering N signals T11, . . . , T1N corresponding to N respective speakers H'1, H'N, arranged regularly around a point. As a result, the matrix AmbInv(p) is deduced from the transposition of the matrix Amb(p,N) which is the ambisonic encoding matrix resulting from the encoding of the sound scene defined by the N sources corresponding to the N speakers H'1, H'N and arranged respectively in the positions $\xi_1, \dots, \xi_N$. Thus we can write that:

$$AmbInv(p) = \frac{1}{N} Amb(p, N)^t.$$

T1 is the matrix of the spectral components T1(*i*, j) of the signals T1*i*, i=1 to N associated with the frequency bands $F_j$, j=0 to M−1. These spectral components come from the inverse ambisonic transformation of order p applied to the quantified ambisonic components $\overline{A}$(k, j), k=1 to Q and j=0 to M−1.

$$\underline{T1} = \begin{bmatrix} T1(1,0) & T1(1,1) & \dots & T1(1,M-1) \\ T1(2,0) & T1(2,1) & \dots & T1(2,M-1) \\ \vdots & & & \vdots \\ T1(N,0) & \dots & \dots & T1(N,M-1) \end{bmatrix}$$

and we have $$\underline{T1} = \underline{AmbInv(p)} \times \overline{A} = \frac{1}{N} Amb(p, N)^t \times \overline{A} \qquad \text{Equation (6)}$$

Thus the components T1(*i*, j), i=1 to N, depend on the quantification error associated with the considered quantification of the ambisonic components A(k, j), k=1 to Q and j=0 to M−1(in fact, each quantified element $\overline{A}$(k, j) is the sum of the spectral parameter A(k, j) of the ambisonic component to be quantified and of the quantification noise associated with said parameter).

For each frequency band $F_j$, j=0 to M−1, using the equations (5), the generalized Gerzon angle vector $\underline{\xi}_j$ (0) is then calculated at the initialization of the process Proc2 (n=0), as a function of the spectral components T1 (i, j), i=1 to N and i=0 to M−1 determined following the ambisonic decoding:

$$\underline{\xi}_j(0) = \begin{pmatrix} \xi_{Vj} \\ \xi_{Ej} \end{pmatrix},$$

with $$\xi_i = \frac{2\pi(i-1)}{N},$$

i=1 to N:

$$\xi_{Vj} = \text{sign}\left( \frac{\sum_{1 \le i \le N} T1(i,j)\sin\xi_i}{\sum_{1 \le i \le N} T1(i,j)} \right) \cdot \arccos\left( \frac{\sum_{1 \le i \le N} T1(i,j)\cos\xi_i}{\sum_{1 \le i \le N} T1(i,j)} \right)$$

$$\xi_{Ej} = \text{sign}\left( \frac{\sum_{1 \le i \le Q} T1(i,j)^2\sin\xi_i}{\sum_{1 \le i \le Q} T1(i,j)^2} \right) \cdot \arccos\left( \frac{\sum_{1 \le i \le Q} T1(i,j)^2\cos\xi_i}{\sum_{1 \le i \le Q} T1(i,j)^2} \right)$$

And $\xi_j(0)=\underline{\xi}_j$ (0) is defined.

It will be noted that here an ambisonic decoding matrix has been considered for a regular sound rendering device which comprises a number of speakers equal to the number of the input signals, which simplifies the calculation of the ambisonic decoding matrix. Nevertheless, this step can be implemented by considering an ambisonic decoding matrix corresponding to non-regular sound rendering devices and also for a number of speakers different from the number of the input signals.

Iteration No. 1 (n=1)

Step 2*d*

A rate $D_1=D_0-\delta_0$ and an allocation of this rate $D_1$ between the elements to be encoded A(k, j), for (k, j)$\epsilon E_0$ are defined.

Step 2*e:*

Then each element to be encoded A(k, j), (k, j)$\epsilon E_0$ is quantified by the quantification module 10 as a function of the rate which has been allocated to it in step 2*d*.

$\overline{A}$ is now the updated matrix of the quantified elements $\overline{A}$(k,j), (k, j)$\epsilon$ $E_0$ each resulting from this last quantification according to the overall rate $D_1$, of the parameters A(k, j).

Step 2*f:*

In a manner similar to that described previously in step 2*c*, after calculation of a new ambisonic decoding of order p carried out as a function of the elements quantified with the overall rate $D_1$, a calculation is made, for the iteration No. 1 of the process Proc2, of a first generalized Gerzon angle vector $\underline{\xi}_j$ (1) in each frequency band $F_j$, as a function of the spectral components T1(*i*, j), i=1 to N, j=0 to M−1 determined following the new ambisonic decoding, using equation (6).

Then a calculation is made of the vector $\Delta\underline{\xi}$ (1) equal to the difference between the Gerzon angle vector $\underline{\xi}_j$(0) calculated in step 2*c* of the initialization and the generalized Gerzon angle vector $\xi_j(1)$ calculated in step 2*f* of iteration No. 1: $\Delta\xi_j(1)=\xi_j(1)-\xi_j(0)$, j=0 to M−1.

Step 2*q:*

The norm $\|\Delta\xi_j(1)\|$ of the variation $\Delta\xi_j(1)$, j=0 to M−1 is calculated in each frequency band $F_j$.

This norm represents the variation in the generalized Gerzon angle vector following the reduction of the rate from $D_0$ to $D_1$ in each frequency band $F_j$.

$j_i$, the index of the frequency band $F_{j_1}$, is determined such that the norm $\|\Delta\xi_{j_1}(1)\|$ of the variation in the Gerzon angle calculated in the frequency band $F_{j_1}$ is less than or equal to each norm $\|\Delta\xi_j(1)\|$, calculated for each frequency band $F_j$, j=0 to M−1. We therefore have $$j_1 = \arg\min_{j=0\ldots M-1} \|\Delta\xi_j(1)\|.$$

Step 2*h:*

The spectral parameters of the ambisonic components relative to the spectral band $F_{j_1}$, i.e. the parameters $A(k, j_1)$, with $k\in F_0=[1,Q]$ are now considered.

And the following steps 2*h*1 to 2*h*5 are reiterated for any $i\in F_0$ considered in turn from 1 to Q:

2*h*1—it is considered that the sub-band $(i,j_1)$ is deleted for the operations 2*h*2 to 2*h*4: it is therefore considered that $A(i,j_1)$ is zero and that the corresponding quantified element $\overline{A}(i, j_i)$ is also zero;

2*h*2—In a manner similar to that described previously in step 2*c*, after calculation of an ambisonic decoding of order p carried out as a function of the quantified elements with the overall rate $D_1$ ($\overline{A}(i, j_i)$ being zero), the generalized Gerzon angle vector $\xi_{j_1}(A(i, j_i)=0, 1)$ is determined in the frequency band $F_{j_1}$ as a function of the spectral components T1(i, j), i=1 to N and j=0 to M−1 determined following said ambisonic decoding using equation (6).

2*h*3—A calculation is then made of the vector $\Delta\xi_{j_1}(1)$ representing the difference in the frequency band $F_{j_1}$ between the generalized Gerzon angle vector $\xi_{j_1}(A(i, j_1)=0, 1)$ calculated above and the generalized Gerzon angle vector $\xi_{j_1}(1)$ calculated in step 2*f* of iteration No. 1 above: $\xi_{j_1}(1)=\xi_{j_1}(A(i, j_1)=0, 1)-\xi_{j_1}(1)$. Then the norm $\|\Delta\xi_{j_1}(1)\|$ of the vector $\Delta\xi_{j_1}(1)$ is calculated: $\Delta\xi_{j_1}(1)=\|\Delta\xi_{j_1}(1)\|=\|\xi_{j_1}(A(i, j_1)=0, 1)-\xi_{j_1}(1)\|$.

This norm represents the variation in the generalized Gerzon angle vector in the frequency band $F_{j_1}$ when for a rate D1, the frequency ambisonic component $A(i, j_1)$ is deleted.

2*h*4—If $i\neq\max F_0$, it is considered that the sub-band $(i, j_1)$ is no longer deleted and we pass to step 2*h*5. If $i=\max F_0$, it is considered that the sub-band $(i, j_1)$ is no longer deleted and we pass to step 2*i*.

2*h*5—i in the set $F_0$ is incremented and steps 2*h*1 to 2*h*4 are reiterated for the value of i thus updated until $i=\max F_0$.

Thus, Q generalized Gerzon angle variation values $\|\Delta\xi_{j_1}(1)\|$, for each $i\in F_0=[1,Q]$ are obtained.

Step 2*i:*

The values $\|\Delta\xi_{j_1}(1)\|$, for each $i\in F_0=[1,Q]$, are compared with each other, the minimum value among these values is identified and the index $i_1\in F_0$ corresponding to the minimum value is determined, i.e.

$$i_1 = \arg\min_{i\in F_0} \|\Delta\xi_{j_1}(1)\|.$$

The component $A(i_1, j_1)$ is thus identified as the least important element to be encoded with respect to spatial precision, compared to the other elements to be encoded A(k, j), $(k, j)\in E_0$.

Step 2*j:*

For each spectral band Fj, the generalized Gerzon angle vector $\xi_j(1)$ resulting from iteration 1 is redefined, calculated for a rate $D_1$:

$$\xi_j(1)=\xi_j(1) \text{ if } j\in[0,M-1]\backslash\{j_1\};$$

$$\xi_{j_1}(1)=\xi_{j_1}(A(i_1, j_1)=0, 1) \text{ if } j=j_1.$$

This redefined generalized Gerzon angle vector, established for a quantification rate equal to $D_1$, takes into account the deletion of the element to be encoded $A(i_1, j_1)$ and will be used for the following iteration of the process Proc2.

Step 2*k:*

The identifier of the pair $(i_1, j_1)$ is delivered to the sequencing module 6 as result of the 1st iteration of the process Proc2.

Step 2*m:*

The element to be encoded $A(i_1, j_1)$ is then deleted from the set of elements to be encoded in the remainder of the process Proc2.

The set $E_1=E_0\backslash(i_1, j_1)$ is defined.

$\delta_1=\min d_{k,j}$, for $(k, j)\in E_1$ is defined.

In an iteration No. 2 of the process Proc2, steps similar to steps 2*d* to 2*n* indicated above are reiterated.

The process Proc2 is reiterated as many times as desired to sequence some or all of the elements to be encoded A(k, j), $(k, j)\in E_1$ remaining to be sequenced.

Thus steps 2*d* to 2*n* described above are reiterated for an nth iteration:

Iteration n (n>1):

$E_{n-1}=E_0\backslash\{(i_1, j_1), \ldots, (i_{n-1}, j_{n-1})\}$.

The elements to be encoded A(k, j), for $(k, j)\in E_0\backslash E_{n-1}$ have been deleted during steps 2*m* of the previous iterations.

Step 2*d:*

A rate $D_n=D_{n-1}-\delta_{n-1}$ and an allocation of this rate $D_n$ between the elements to be encoded A(k, j), for $(k, j)\in E_{n-1}$ are defined.

During the calculation of the ambisonic decodings carried out hereafter, it is therefore considered that the quantified elements $\overline{A}(k, j)$, for $(k, j)\in E_0\backslash E_{n-1}$ are zero.

Step 2*e:*

Then each element to be encoded A(k, j), $(k, j)\in E_{n-1}$, is quantified by the quantification module 10 as a function of the rate allocated in step 2*d* above.

The result of this quantification of the element to be encoded A(k, j) is $\overline{A}(k,j)$, $(k, j)\in E_{n-1}$.

Step 2*f:*

In a manner similar to that described previously for iteration 1, after calculation of an ambisonic decoding of order p carried out as a function of the elements quantified with the overall rate $D_n$ (it was therefore considered during this ambisonic decoding that the components) $\overline{A}(i_1, j_1), \ldots, \overline{A}(i_{n-1}, j_{n-1})$ were zero), for iteration n of the process Proc2, a first generalized Gerzon angle vector $\xi_j(n)$ in each frequency band $F_j$ is calculated as a function of the spectral components T1*i*, i=1 to N determined following said ambisonic decoding, using equation (6).

A calculation is then made of the vector $\Delta\xi_j(n)$ equal to the difference between the Gerzon angle vector $\xi_j(n-1)$ calculated in step 2*j* of iteration n−1 and the generalized Gerzon angle vector $\underset{\sim}{\xi}_j(n)$ calculated in the present step: $\Delta\underset{\sim}{\xi}_j(n)=\underset{\sim}{\xi}_j(n)-\xi_j(n-1)$ j=0 to M−1.

Step 2*g:*

The norm $\|\Delta\underset{\sim}{\xi}_j(n)\|$ of the variation $\Delta\underset{\sim}{\xi}_j(n)$, j=0 to M−1, is calculated in each frequency band $F_j$.

This norm represents the variation in the generalized Gerzon angle vector in each frequency band $F_j$, following the rate reduction from $D_n$ to $D_{n-1}$ (the parameters $A(i_1, j_1), \ldots, A(i_{n-1}, j_{n-1})$ and $\overline{A}(i_1, j_1), \ldots, \overline{A}(i_{n-1}, j_{n-1})$ being deleted).

$j_n$ the index of the frequency band $F_{j_n}$ is determined such that the norm $\|\Delta\underset{\sim}{\xi}_{j_n}(n)\|$ of the variation in the Gerzon angle vector calculated in the frequency band $F_{j_n}$ is less than or equal to each norm $\|\Delta\underset{\sim}{\xi}_j(n)\|$, calculated for each frequency band $F_j$, j=0 to M−1. We therefore have $$j_n = \arg\min_{j=0\ldots M-1}\|\Delta\underset{\sim}{\xi}_j(1)\|.$$

Step 2*h:*

The spectral parameters of the ambisonic components relative to the spectral band $F_{j_n}$, are now considered, i.e. the parameters $A(k, j_n)$, with $k\in F_{n-1}=\{i\in[1\ldots, Q]$ such that $(i, j_n)\in E_{n-1}\}$.

And the following steps 2*h*1 to 2*h*5 are reiterated for any $i\in F_{n-1}$ considered in turn from the smallest element in the set $F_{n-1}$ (min $F_{n-1}$) to the largest element in the set $F_{n-1}$ (max $F_{n-1}$):

2*h*1—it is considered that the sub-band $(i, j_n)$ is deleted for operations 2*h*2 to 2*h*4: it is therefore considered that $A(i, j_n)$ is zero and that the corresponding quantified element $\overline{A}(i, j_n)$ is also zero;

2*h*2—In a manner similar to that described previously in step 2*c*, after calculation of an ambisonic decoding of order p carried out as a function of the elements quantified with the overall rate $D_n$ ($\overline{A}(i, j_n)$ being zero), the generalized Gerzon angle vector named $\underset{\sim}{\xi}_{j_n}(A(i, j_n)=0,n)$ in the frequency band $F_{j_n}$ calculated as a function of the spectral components T1(*i*, j) i=1 to N and j=0 to M−1 determined following said ambisonic decoding, using equation (6).

2*h*3—A calculation is then made of the vector $\Delta\underset{\sim}{\xi}_{j_n}(n)$ equal to the difference, in the frequency band $F_{j_n}$, between the generalized Gerzon angle vector $\underset{\sim}{\xi}_{j_n}(A(i, j_n)=0,n)$ calculated above in 2*h*2 and the generalized Gerzon angle vector $\underset{\sim}{\xi}_{j_n}(n)$ calculated in step 2*f* of iteration n above: $\Delta\underset{\sim}{\xi}_{j_n}(n)=\underset{\sim}{\xi}_j(A(i,j_n)=0, n)-\underset{\sim}{\xi}_{j_n}(n)$.

Then the norm $\|\Delta\underset{\sim}{\xi}_{j_n}(n)\|$ of the vector $\Delta\underset{\sim}{\xi}_{j_n}(n)$: $\|\Delta\underset{\sim}{\xi}_{j_n}(n)\|=\|\underset{\sim}{\xi}_{j_n}(A(i, j_n)=0, n)-\underset{\sim}{\xi}_{j_n}(n)\|$ is calculated.

This norm represents the variation, in the frequency band $F_{j_n}$, of the generalized Gerzon angle vector and for a rate $D_n$, due to the deletion of the ambisonic component $A(i, j_n)$ during the nth iteration of the process Proc2.

2*h*4—If $i\neq\max F_{n-1}$, it is considered that the sub-band $(i, j_n)$ is no longer deleted and we go to step 2*h*5. If $i=\max F_{n-1}$, it is considered that the sub-band $(i, j_n)$ is no longer deleted and we go to step 2*i*.

2*h*5—i is incremented in the set $F_{n-1}$ and steps 2*h*1 to 2*h*4 are reiterated for the value of i thus updated until $i=\max F_{n-1}$.

Thus, for each $i\in F_{n-1}$, a value $\|\Delta\underset{\sim}{\xi}_{ij_n}(n)\|$ is obtained representing the variation in the generalized Gerzon angle vector in the frequency band $F_{j_n}$ due to the deletion of the component $A(i, j_n)$.

Step 2*i:*

A comparison is made between the values $\|\Delta\underset{\sim}{\xi}_{ij_n}(n)\|$, for each $i\in F_{n-1}$, the minimum value among these values is identified and the index $i_n\in F_n$ is determined corresponding to the minimum value, i.e.

$$i_n = \arg\min_{i\in F_n}\|\Delta\underset{\sim}{\xi}_{ij_n}(n)\|.$$

The component $A(i_n, j_n)$ is thus identified as the element to be encoded of least importance with respect to spatial precision, compared to the other elements to be encoded $A(k, j)$, $(k, j)\in E_{n-1}$.

Step 2*j:*

For each spectral band $F_j$, a generalized Gerzon angle vector $\xi_j(n)$ is redefined resulting from iteration n:

$$\xi_j(n)=\underset{\sim}{\xi}_j(n) \text{ if } j\in[0,M-1]\backslash\{j_n\};$$

$$\xi_{j_n}(n)=\underset{\sim}{\xi}_{j_n}(A(i_n,j_n)=0,n) \text{ if } j=j_n.$$

This redefined generalized Gerzon angle, established for a quantification rate equal to $D_n$, takes into account the deletion of the element to be encoded $A(i_n, j_n)$ and will be used for the following iteration.

Step 2*k:*

The identifier of the pair $(i_n, j_n)$ is delivered to the sequencing module 6 as result of the nth iteration of the process Proc2.

Step 2*m:*

Then the band $(i_n, j_n)$ is deleted from the set of elements to be encoded in the remainder of the process Proc2, i.e. the element to be encoded $A(i_n, j_n)$ is deleted.

The set $E_n=E_{n-1}\backslash(i_n, j_n)$ is defined. The elements to be encoded A(i, n, with $(i, j)\in E_n$ remain to be sequenced. The elements to be encoded A(i, j), with $(i, j)\in\{(i_1, j_1)\ldots, (i_n, j_n)\}$ have already been sequenced during the iterations 1 to n.

The process Proc2 is reiterated r times and a maximum of Q*M-1 times.

Priority indices are thus then allocated by the sequencing module 6 to the different elements to be encoded, with a view to the insertion of the encoding data into a binary sequence.

Sequencing of the elements to be encoded and constitution of a binary sequence, based on the results successively provided by the successive iterations of the process Proc2:

In an embodiment where the sequencing of the elements to be encoded is carried out by the sequencing module 6 based on the results successively provided by the successive iterations of the process Proc2 implemented by the module 5 for definition of the least relevant elements to be encoded (excluding the results provided by the process Proc1), the sequencing module 6 defines an order of said elements to be encoded, reflecting the importance of the elements to be encoded with respect to spatial precision.

Figure 5B:
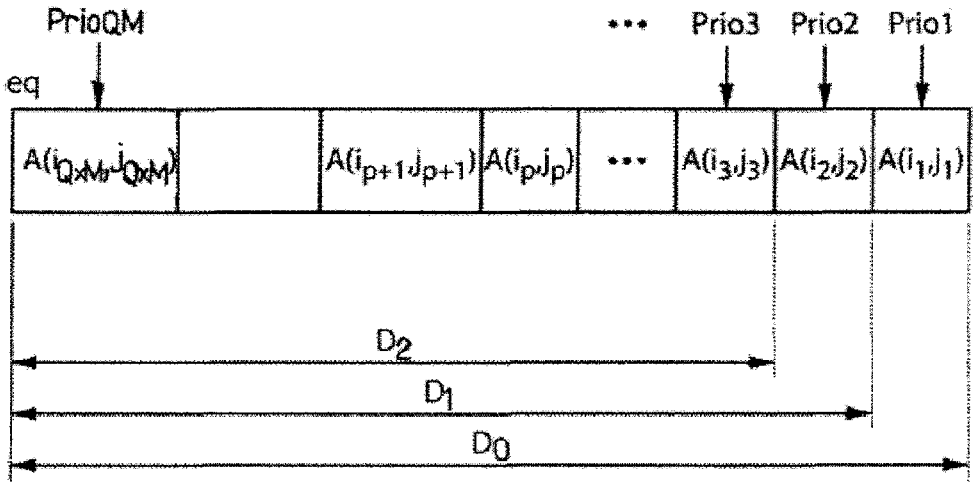
FIG. 5*b* represents a binary sequence Seq constructed in another embodiment of the invention.

With reference to FIG. 5*b*, the element to be encoded $A(i_1, j_1)$ corresponding to the pair $(i_1, j_1)$ determined during the first iteration of the process Proc2 is considered as the least relevant with respect to spatial precision. It is therefore assigned a minimum priority index Prio1 by the module 5.

The element to be encoded $A(i_2, j_2)$ corresponding to the pair $(i_2, j_2)$ determined during the second iteration of the process Proc2, is considered as the least relevant element to be encoded with respect to spatial precision, after that assigned the priority Prio1. It is therefore assigned a minimum priority index Prio2, with Prio2>Prio1. The sequencing module 6 thus successively schedules r elements to be encoded each assigned increasing priority indices Prio1, Prio2 to Prio r.

The elements to be encoded which have not been assigned an order of priority during an iteration of the process Proc2 are more important with respect to spatial precision than the elements to be encoded to which an order of priority has been assigned.

When r is equal to Q*M−1 times, the set of elements to be encoded are sequenced one by one.

In the following, it is considered that the number of iterations r of the process Proc2 carried out is equal to Q*M−1 times.

The order of priority assigned to an element to be encoded A(k, j) is also assigned to the element encoded as a function of the result $\overline{A}(k, j)$ of the quantification of this element to be encoded. The encoded element corresponding to the element to be encoded A(k, j) is also denoted $\overline{A}(k, j)$.

The module 8 for constitution of the binary sequence constitutes a binary sequence Seq corresponding to a frame of each of the signals Si, i=1 to N successively integrating into it encoded elements $\overline{A}(k, j)$ in decreasing order of assigned priority indices, the binary sequence Seq being to be transmitted in the bitstream ϕ.

Thus the binary sequence constituted Seq is sequenced according to the sequencing carried out by the module 6.

In the embodiment considered above, a deletion of a spectral component from an element to be encoded A(i, j) takes place at each iteration of the process Proc2.

In another embodiment, an imbricated quantifier is used for the quantification operations. In such a case, the spectral component of an element to be encoded A(i, j) identified as the least important with respect to spatial precision during an iteration of the process Proc2 is not deleted, but a reduced rate is assigned to the encoding of this component with respect to the encoding of the other spectral components of elements to be encoded remaining to be sequenced.

The encoder 1 is thus an encoder allowing a rate adaptability taking into account the interactions between the different monophonic signals. It makes it possible to define compressed data optimizing the perceived spatial precision.

Combination of the Methods Proc1 and Proc2

In an embodiment, the least important elements to be encoded are defined using a method Proc combining the methods Proc1 and Proc2 described above, as a function of criteria taking into account the overall audio quality and spatial relevance.

The initialization of the method Proc comprises the initializations of the methods Proc1 and Proc2 as described above.

Figure 11:
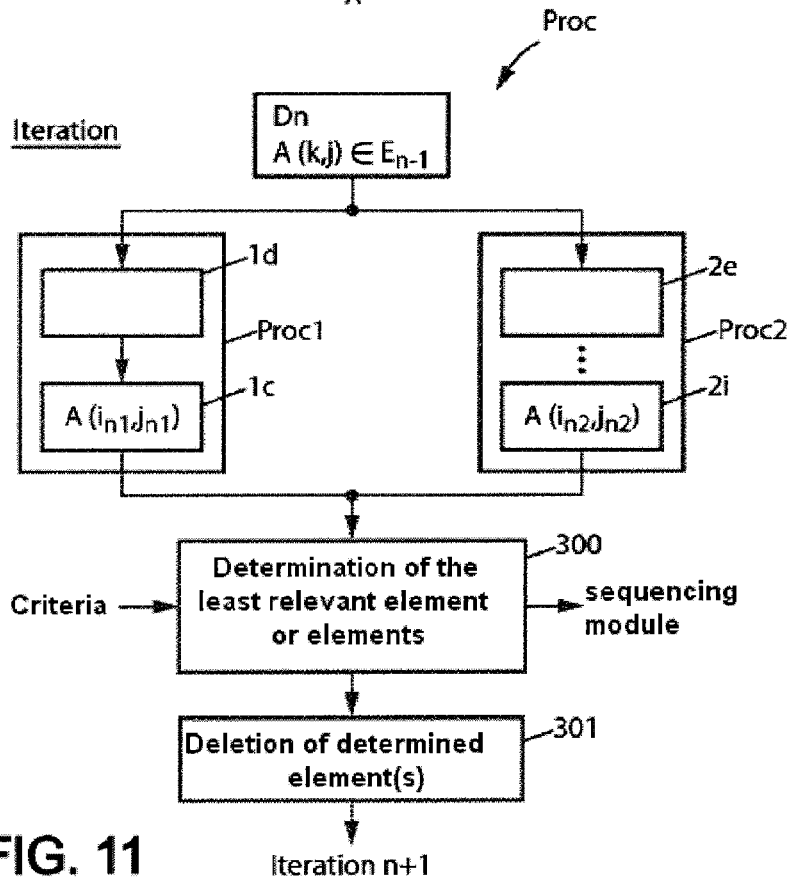
FIG. 11 is a flowchart representing steps of a method Proc in an embodiment of the invention.

An iteration n (n>1) of such a method Proc will now be described with reference to FIG. 11, considering an (n+1)th encoding rate $D_n$ and a set of elements to be encoded A(k, j) with $(k, j) \in E_{n-1}$ to be sequenced.

This rate and this set of elements to be encoded are determined during previous iterations of the method Proc based on previous iterations of the method Proc using the methods Proc1 and Proc2. The previous iterations have allowed the determination of elements to be encoded determined as the least important as a function of defined criteria.

These defined criteria have been established as a function of the desired overall audio quality and spatial precision.

An iteration of steps 1*d* and 1*e* of the process Proc1 is implemented on this set of elements to be sequenced in parallel, identifying the least relevant element to be encoded $A(i_{n1}, j_{n1})$ with respect to the overall audio quality and an iteration of the steps 2*e* to 2*i* of the process Proc2, identifying the least relevant element to be encoded $A(i_{n2}, j_{n2})$ with respect to spatial precision.

As a function of the defined criteria, in step 300, a single one of the two identified elements to be encoded or also both identified elements to be encoded are selected. This or each selected element to be encoded is denoted $A(i_n, j_n)$.

Then, on the one hand, the identifier or identifiers of the pair $(i_n, j_n)$ is/are supplied to the sequencing module 6 as a result of the nth iteration of the process Proc2, which assigns to it a priority Prion in view of the criteria defined. The assigned priority Prion is greater than the priority of the elements to be encoded selected during the previous iterations of the method Proc as a function of the criteria defined. This step replaces steps 1*f* of the process Proc1 and 2*k* of the process Proc2 as described previously.

The selected element or elements to be encoded $A(i_n, j_n)$ are then inserted into the binary sequence to be transmitted before the elements to be encoded selected during the previous iterations of the method Proc (as the element to be encoded $A(i_n, j_n)$ is more important with respect to the defined criteria than the elements to be encoded previously selected by the method Proc). The selected element or elements to be encoded $A(i_n, j_n)$ are inserted into the binary sequence to be transmitted after the other elements to be encoded of the set $E_{n-1}$ (as the element to be encoded $A(i_n, j_n)$ is less important with respect to the criteria defined than these other elements to be encoded).

On the other hand, in a step 301, the element or elements to be encoded $A(i_n, j_n)$ selected for the following iteration (iteration n+1) of the method Proc (comprising an iteration n+1 for the Proc1 and Proc2 methods) is/are deleted, which will then be applied to the set of elements to be encoded $E_n = E_{n-1} \backslash A(i_n, j_n)$, based on a reduced rate as defined in step 1*c* of the process Proc1 and step 2*n* of the process Proc2.

This step 301 replaces the steps 1*g* of the methods Proc1 and 2*m* of the process Proc2 as described previously.

The criteria defined make it possible to select that or those of the least relevant elements identified respectively during step 300 of the method Proc.

For example, in an embodiment, the element identified by the process Proc1 at each iteration n is deleted, with n even and the element identified by the process Proc2 at each iteration n is deleted with n odd, which makes it possible best to retain the overall audio quality and spatial precision.

Other criteria can be used. An encoding implementing such a method Proc thus makes it possible to obtain a bitstream which is adaptable in rate with respect to the audio quality and with respect to spatial precision.

Operations Carried Out at the Level of the Decoder

The decoder 100 comprises a binary sequence reading module 104, an inverse quantification module 105, an inverse ambisonic transformation module 101 and a frequency/time transformation module 102.

The decoder 100 is suited to receiving at the input the bitstream ϕ transmitted by the encoder 1 and delivering at the output Q' signals S'1, S'2, . . . , S'Q' intended to supply the Q' respective speakers H1, . . . , HQ' of a sound rendering system 103. The number of speakers Q' can in an embodiment be different from the number Q of ambisonic components transmitted.

Figure 7:
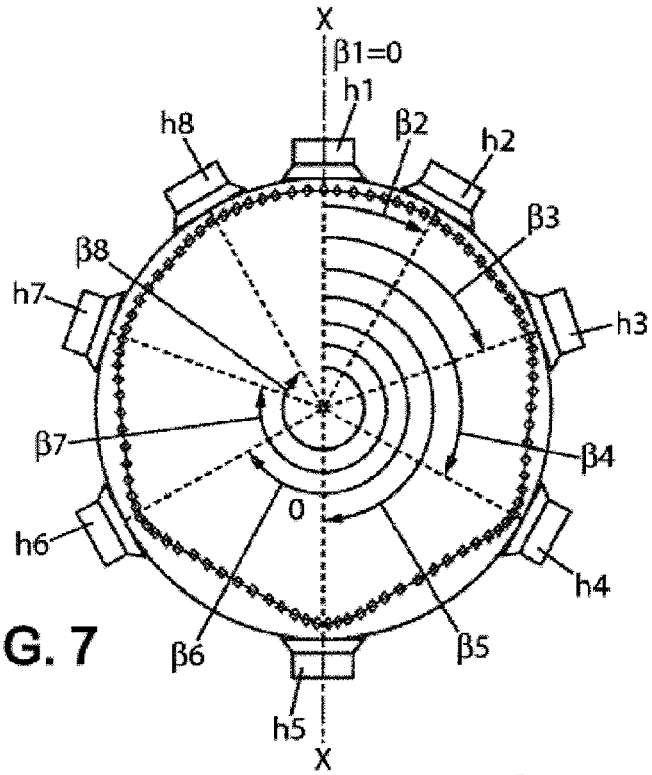
FIG. 7 represents an example of a configuration of a sound rendering system comprising 8 speakers h1, h2 . . . , h8.

By way of example, the configuration of a sound rendering system comprising 8 speakers h1, h2 . . . , h8 is shown in FIG. 7.

The binary sequence reading module 104 extracts from the received binary sequence ϕ data indicating the quantification indices determined for elements $\overline{A}(k, j)$, k=1 to Q and j=0 to M−1 and supplies them to the input of the inverse quantification module 105.

The inverse quantification module 105 carries out an inverse quantification operation.

The elements of the matrix $\overline{A}'$ of the elements $\overline{A}'(k, j)$, k=1 to Q and j=0 to M−1, are determined, such that $\overline{A}'(k, j)=\overline{A}(k, j)$ when the received sequence comprised data indicating the quantification index of the element $\overline{A}(k, j)$ resulting from the encoding of the parameters A(k, j) of the ambisonic components by the decoder 100 and $\overline{A}'(k, j)=0$ when the received sequence did not comprise data indicating the quantification index of the element $\overline{A}(k, j)$ (for example these data have been cut out during the transmission of the sequence at the level of a streaming server in order to adapt to the available rate in the network and/or to the characteristics of the terminal).

The inverse spatial transformation module 101 is suited to determining the elements X'(i, j), i=1 to Q', j=0 to M−1, of the matrix X' defining the M spectral coefficients X'(i, j), i=1 to Q', j=0 to M−1, of each of the Q'i signals S'i, based on the ambisonic components A' (k, j), k=1 to Q and j=0 to M−1, determined by the inverse quantification module 105.

AmbInv(p',Q') is the inverse ambisonic transformation matrix of order p' for the 3D scene suited to determining the Q' signals S'i, i=1 to Q', intended for the Q' speakers of the sound rendering system associated with the decoder 100, based on the Q ambisonic components received. The angles βi, for i=1 to Q', indicate the angle of acoustic propagation from the speaker Hi. In the example represented in FIG. 7, these angles correspond to the angles between the axis of propagation of a sound emitted by a speaker and the axis XX.

X' is the matrix of the spectral components X'(i, j) of the signals Si', i=1 to Q' relative to the frequency bands Fj, j=0 to M−1. Thus:

$$\underline{\overline{A}'} = \begin{bmatrix} \overline{A}'(1,0) & \overline{A}'(1,1) & \dots & \overline{A}'(1,M-1) \\ \overline{A}'(2,0) & & & \overline{A}'(2,M-1) \\ \vdots & & & \vdots \\ \overline{A}'(Q,0) & \overline{A}'(Q,1) & \dots & \overline{A}'(Q,M-1) \end{bmatrix},$$

$$\underline{AmbInv(p',Q')} = \begin{bmatrix} 1 & \frac{1}{\sqrt{2}}\cdot\cos\beta 1 & \frac{1}{\sqrt{2}}\cdot\sin\beta 1 & \dots & \frac{1}{\sqrt{2}}\cdot\sin p'\beta 1 \\ 1 & \frac{1}{\sqrt{2}}\cdot\cos\beta 2 & \vdots & \vdots & \frac{1}{\sqrt{2}}\cdot\sin p'\beta 2 \\ \vdots & & \vdots & \vdots & \vdots \\ 1 & \frac{1}{\sqrt{2}}\cdot\cos\beta Q' & \dots & \dots & \frac{1}{\sqrt{2}}\cdot\sin p'\beta Q' \end{bmatrix}$$

and $$\underline{X'} = \begin{bmatrix} X'(1,0) & X'(1,1) & \dots & X'(1,M-1) \\ X'(2,0) & & & X'(2,M-1) \\ \vdots & & & \vdots \\ X'(Q',0) & \dots & \dots & X'(Q',M-1) \end{bmatrix}$$

and we have $\underline{X'} = \underline{AmbInv(p',Q')} \times \underline{\overline{A}'}$.

Equation (7)

The inverse spatial transformation module 101 is suited to determining the spectral coefficients X'(i, j), i=1 to Q', j=0 to M−1, elements of the matrix $\underline{X}'$, using equation (7).

These elements X'(i, j), i=1 to Q', j=0 to M−1, once determined, are delivered to the input of the frequency/time transformation module 102.

The frequency/time transformation module 102 of the decoder 100 transforms the space of frequency representation to the space of time representation based on the spectral coefficients received X'(i, j), i=1 to Q', j=0 to M−1 (this transformation is, in the present case, an inverse MDCT), and it thus determines a time frame of each of the Q' signals S'1 . . . , S'Q'.

Each signal S'i, i=1 to Q', is intended for the speaker Hi of the sound rendering system 103.

At least some of the operations carried out by the decoder are, in an embodiment, implemented following the execution of computer program instructions on processing means of the decoder.

An advantage of the encoding of the components resulting from the ambisonic transformation of the signals S1, . . . , SN as described is that in the case where the number of signals N of the sound scene is large, they can be represented by a number Q of ambisonic components much less than N, while degrading the spatial quality of the signals very little. The volume of data to be transmitted is therefore reduced without significant degradation of the audio quality of the sound scene.

Another advantage of an encoding according to the invention is that such encoding allows adaptability to the different types of sound rendering systems, whatever the number, arrangement and type of speakers with which the sound rendering system is provided.

In fact, a decoder receiving a binary sequence comprising Q ambisonic components operates on the latter an inverse ambisonic transformation of the order of any p' and corresponding to the number Q' of speakers of the sound rendering system for which the signals once decoded are intended.

An encoding as carried out by the encoder 1 makes it possible to sequence the elements to be encoded as a function of their respective contribution to the audio quality using the first process Proc1 and/or as a function of their respective contribution to the spatial precision and the accurate reproduction of the directions contained in the sound scene, using the second process Proc2.

In order to adapt to the imposed rate constraints, it is sufficient to truncate the sequence of the elements of lower priority arranged in the sequence. It is then guaranteed that the best overall audio quality (when the process Proc1 is implemented) and/or the best spatial precision (when the process Proc2 is implemented) is provided. In fact, the sequencing of the elements has been carried out in such a way that the elements which contribute least to the overall audio quality and/or spatial precision are placed at the end of the sequence.

The methods Proc1 and Proc 2 can be implemented, according to the embodiments, in combination or even alone, independently of one another in order to define a binary sequence.

The invention claimed is:

1. A method for sequencing spectral components associated with respective spectral bands of elements to be encoded originating from an audio scene comprising N signals, with N>1, said method comprising:

calculating a respective influence of at least some of the spectral components which can be calculated as a function of spectral parameters originating from at least some of the N signals, on mask-to-noise ratios determined over the spectral bands as a function of an encoding of said at least some of the spectral components; and allocating an order of priority to at least one spectral component as a function of the influence calculated for said at least one spectral component compared to the influences calculated for other spectral components, the influence of a given component being calculated by estimating a variation between:

a first mask to noise ratio determined as a function of a coding of said at least some of the spectral components according to a first rate, and a second mask to noise ratio determined as a function of a coding of said at least some of the spectral components from which said given component is deleted according to a second rate lower than the first rate.

2. The method according to claim 1, wherein the calculation of the influence of a spectral component comprises:

a. encoding a first set of spectral components of elements to be encoded according to a first rate;

b. determining a first mask-to-noise ratio per spectral band;

c. determining a second rate less than said first one;

d. deleting said usual spectral component of the elements to be encoded and encoding of the remaining spectral components of the elements to be encoded according to the second rate;

e. determining a second mask-to-noise ratio per spectral band;

f. calculating a variation in mask-to-noise ratio as a function of the determined differences between the first and second mask-to-noise ratios for the first and the second rate per spectral band; and g. iterating steps d to f for each of the spectral components of the set of spectral components of elements to be encoded for sequencing and determination of a variation in minimum mask-to-noise ratio; the order of priority allocated to the spectral component corresponding to the minimum variation being a minimum order of priority.

3. The method according to claim 2, further comprising:

reiterating steps a to g with a set of spectral components of elements to be encoded for sequencing restricted by deletion of the spectral components for which an order of priority has been allocated.

4. The method according to claim 2, further comprising:

reiterating steps a to g with a set of spectral components of elements to be encoded for sequencing in which the spectral components for which an order of priority has been allocated are assigned a more reduced quantification rate during the use of an imbricated quantifier.

5. The method according to claim 1, wherein the elements to be encoded comprise the spectral parameters calculated for the N signals.

6. The method according to claim 1, wherein the elements to be encoded comprise elements obtained by spatial transformation of the spectral parameters calculated for the N signals.

7. The method according to claim 6, wherein said spatial transformation is an ambisonic transformation.

8. The method according to claim 6, further comprising determining the mask-to-noise ratios as a function of the errors due to the encoding and associated with elements to be encoded, of a spatial transformation matrix and of a matrix determined as a function of the transpose of said spatial transformation matrix.

9. The method according to claim 6, some of the spectral components being spectral parameters of ambisonic components, said method further comprising:

a. calculating a respective influence of at least some of said spectral components, on an angle vector defined as a function of energy and velocity vectors associated with Gerzon criteria and calculated as a function of an inverse ambisonic transformation on said quantified ambisonic components; and b. allocating an order of priority to at least one spectral parameter as a function of the influence calculated for said spectral parameter compared to the other influences calculated.

10. A sequencing module comprising algorithms for implementing a method for sequencing spectral components associated with respective spectral bands of elements to be encoded originating from an audio scene comprising N signals, with N>1, said method comprising:

calculating a respective influence of at least some of the spectral components which can be calculated as a function of spectral parameters originating from at least some of the N signals, on mask-to-noise ratios determined over the spectral bands as a function of an encoding of said at least some of the spectral components; and allocating an order of priority to at least one spectral component as a function of the influence calculated for said at least one spectral component compared to the influences calculated for other spectral components, the influence of a given component being calculated by estimating a variation between:

a first mask to noise ratio determined as a function of a coding of said at least some of the spectral components according to a first rate, and a second mask to noise ratio determined as a function of a coding of said at least some of the spectral components from which said given component is deleted according to a second rate lower than the first rate.

11. An audio encoder for encoding a 3D audio scene comprising N respective signals in an output bitstream, with N>1, the audio encoder comprising:

a transformation module that determines, as a function of the N signals, spectral components associated with respective spectral bands;

a sequencing module according to claim 10, that sequences at least some of the spectral components associated with the respective spectral bands; and a module for constructing a binary sequence comprising data indicating the at least some of the spectral components associated with the respective spectral bands as a function of the sequencing carried out by the sequencing module.

12. The method of claim 1, further comprising a non-transitory computer readable medium comprising instructions of a program to be installed in a sequencing module, wherein said program comprises instructions for implementing the steps of the method according to claim 1, during an execution of the program by a processor of said module.

13. A method for sequencing a non-transitory binary sequence comprising spectral components associated with respective spectral bands of elements to be encoded originating from an audio scene comprising N signals with N>1, the method comprising:

sequencing at least some of the spectral components according to the sequencing method according to claim 1.

* * * * *